US008430720B2

(12) United States Patent
Friel, Sr. et al.

(10) Patent No.: US 8,430,720 B2
(45) Date of Patent: Apr. 30, 2013

(54) APPARATUS FOR PRECISION STEELING/CONDITIONING OF KNIFE EDGES

(75) Inventors: Daniel D. Friel, Sr., Greenville, DE (US); Robert P. Bigliano, Wilmington, DE (US); Angela Bigliano, legal representative, Glen Mills, PA (US); Daniel D. Friel, Jr., Kennett Square, PA (US); Abraham Leibson, Lambertville, NJ (US)

(73) Assignee: Edgecraft Corporation, Avondale, PA (US)

( * ) Notice: Subject to any disclaimer, the term of this patent is extended or adjusted under 35 U.S.C. 154(b) by 622 days.

(21) Appl. No.: 12/399,176

(22) Filed: Mar. 6, 2009

(65) Prior Publication Data

US 2009/0181602 A1 Jul. 16, 2009

Related U.S. Application Data

(63) Continuation-in-part of application No. 11/839,650, filed on Aug. 16, 2007, now Pat. No. 7,517,275, which is a continuation-in-part of application No. 11/123,959, filed on May 6, 2005, now Pat. No. 7,287,445, and a continuation-in-part of application No. 10/803,419, filed on Mar. 18, 2004, now Pat. No. 7,235,004.

(60) Provisional application No. 60/568,839, filed on May 6, 2004, provisional application No. 60/457,993, filed on Mar. 27, 2003.

(51) Int. Cl.
*B24B 1/00* (2006.01)

(52) U.S. Cl.
USPC ..... 451/45; 451/267; 451/370; 451/371; 76/82

(58) Field of Classification Search ..... 76/82, 82.2, 76/88; 451/45, 267, 370, 371, 386, 387, 451/405, 541, 552, 553, 555–558
See application file for complete search history.

(56) References Cited

U.S. PATENT DOCUMENTS

| | | | |
|---|---|---|---|
| 690,172 | A | 12/1901 | Montgomery |
| 1,075,690 | A | 10/1913 | Buck |
| 1,100,418 | A | 6/1914 | Christopherson |
| 1,158,048 | A | 10/1915 | Hawks |
| 1,181,161 | A | 5/1916 | Perry |
| 1,223,127 | A | 4/1917 | Walker |
| 1,496,728 | A | 6/1924 | Olson |
| 1,681,763 | A | 8/1928 | Eaton |

(Continued)

FOREIGN PATENT DOCUMENTS

| | | |
|---|---|---|
| GB | 621715 | 4/1949 |
| WO | WO/01/70464 | 9/2001 |

*Primary Examiner* — Maurina Rachuba
(74) *Attorney, Agent, or Firm* — Novak Druce Connolly Bove + Quigg LLP

(57) ABSTRACT

A knife edge enhancing apparatus includes a support having a support surface and knife blade clamping structure mounted to the support and located above the support surface. An object having a knife edge modifying surface which could be abrasive or non-abrasive is mounted to a holder which is freely slidable on the support surface so that the object surface can be manually moved into contact with a knife edge facet. At least one of the clamping structure and the object surface is angularly adjustable to control the angle of contact of the object surface with the knife edge facet.

4 Claims, 12 Drawing Sheets

U.S. PATENT DOCUMENTS 1,909,743 A 5/1933 Blankner
1,936,990 A 11/1933 Piermann
1,957,278 A 5/1934 Ling
2,098,530 A 11/1937 Battocchi
2,249,218 A 7/1941 Meade
2,461,690 A 2/1949 Leong
2,559,273 A 7/1951 Brinkley
2,645,066 A 7/1953 Andrews
2,652,667 A * 9/1953 Arnold ..... 451/555
2,674,072 A 4/1954 Lohmann
2,753,670 A 7/1956 Carapucci
2,795,975 A 6/1957 Stoner
2,896,482 A * 7/1959 Hyde ..... 76/84
3,280,514 A 10/1966 Raymond
3,332,173 A 7/1967 McMaster
3,619,955 A 11/1971 Fischback
3,819,170 A 6/1974 Longbrake
3,894,362 A 7/1975 Graves
4,090,418 A 5/1978 Ishida
4,170,343 A 10/1979 Longbrake
4,197,677 A 4/1980 Graves
4,216,627 A 8/1980 Westrom
4,231,194 A 11/1980 Glesser
4,285,253 A 8/1981 Edling
4,320,892 A 3/1982 Longbrake
4,404,873 A 9/1983 Radish
4,441,279 A 4/1984 Storm
4,450,653 A 5/1984 Fletcher
4,486,982 A 12/1984 Longbrake
4,502,254 A 3/1985 Carter
4,512,112 A 4/1985 LeVine
4,538,382 A 9/1985 Johannsen
4,602,531 A * 7/1986 Korhonen ..... 76/82
4,611,437 A 9/1986 Cohen
4,627,194 A 12/1986 Friel
4,714,239 A 12/1987 LeVine
4,716,689 A 1/1988 Friel
4,751,795 A 6/1988 Jenne
4,777,770 A 10/1988 LeVine
4,799,335 A 1/1989 Battocchi
4,807,399 A 2/1989 Friel
D303,209 S 9/1989 Friel
4,897,965 A 2/1990 Friel
4,912,881 A 4/1990 McDougall
4,912,885 A 4/1990 Bonapace
4,928,343 A 5/1990 Kissinger
4,934,110 A * 6/1990 Juranitch ..... 76/82
D310,620 S 9/1990 Friel
5,005,319 A 4/1991 Friel
D316,662 S 5/1991 Cherniak
5,040,435 A 8/1991 Millman
5,046,385 A 9/1991 Cozzini
D328,410 S 8/1992 Friel
D328,847 S 8/1992 Button
5,138,801 A 8/1992 Anthon et al.
5,148,634 A 9/1992 Bigliano
5,163,251 A 11/1992 Lee
5,185,958 A 2/1993 Dale
5,189,848 A 3/1993 Flaherty
5,199,225 A 4/1993 Esposito
5,245,791 A 9/1993 Bigliano
D342,003 S 12/1993 Friel et al.
D348,598 S 7/1994 Friel
5,357,717 A 10/1994 Friel
5,363,602 A 11/1994 Anthon
5,390,431 A 2/1995 Friel
D357,395 S 4/1995 Friel
5,404,679 A 4/1995 Friel
5,431,070 A * 7/1995 Thames ..... 76/88
5,440,953 A 8/1995 Gangelhoff
5,449,315 A 9/1995 Friel
5,458,534 A 10/1995 Campione
5,461,785 A 10/1995 Sol Na
5,547,419 A * 8/1996 Hulnicki ..... 451/321
5,582,535 A 12/1996 Friel
5,582,542 A 12/1996 Stein
5,586,647 A 12/1996 Barta
5,611,726 A * 3/1997 Friel et al. ..... 451/177
5,636,556 A 6/1997 Friedlander
5,655,959 A * 8/1997 Juranitch ..... 76/82
5,667,427 A 9/1997 Airhart
D388,304 S 12/1997 Friel
5,868,611 A 2/1999 Friel
D408,254 S 4/1999 Friel
D409,891 S 5/1999 Friel
D410,185 S 5/1999 Huber
5,954,571 A 9/1999 Case
6,012,971 A 1/2000 Friel
6,048,262 A 4/2000 Ray
6,059,645 A 5/2000 LeVine
6,113,476 A 9/2000 Friel
6,168,509 B1 1/2001 Presgrove
6,267,652 B1 7/2001 Friel
6,371,841 B1 4/2002 Ray
6,393,946 B1 5/2002 Kenesky
6,547,656 B1 4/2003 LeVine
6,711,791 B2 3/2004 Hess
6,726,551 B2 4/2004 Friel
6,752,702 B1 6/2004 Thompson
6,769,327 B2 8/2004 Henry
6,817,269 B1 11/2004 Grace
6,863,600 B2 3/2005 Friel
6,875,093 B2 4/2005 Friel
6,881,137 B2 4/2005 Friel
7,052,385 B1 5/2006 Swartz
7,235,004 B2 6/2007 Friel
7,287,445 B2 10/2007 Friel
7,467,991 B2 12/2008 McCowen
7,517,275 B2 4/2009 Friel
2002/0144410 A1 10/2002 Hufnagel
2003/0150121 A1 8/2003 Jebe
2006/0276110 A1 12/2006 Friel
2007/0101826 A1 * 5/2007 Harden ..... 76/82

* cited by examiner

Fig.3.
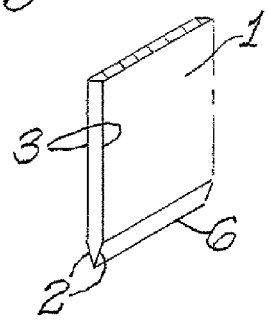
Fig.4.
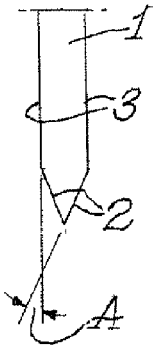
Fig.7.
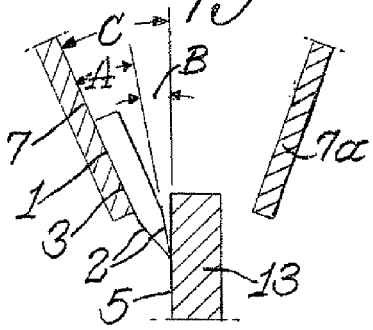
Fig.6.
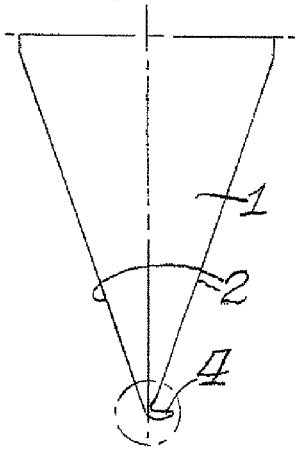
Fig.8.
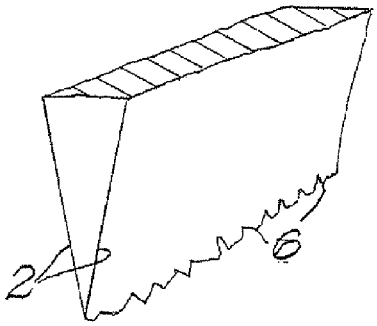
Fig.9.
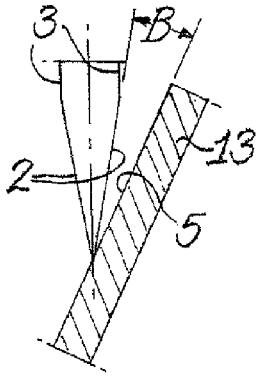
Fig.5(PriorArt)
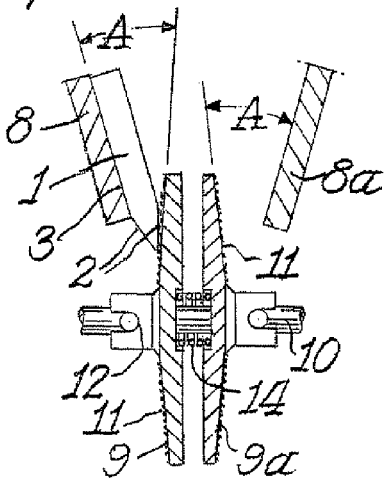
Fig.10.
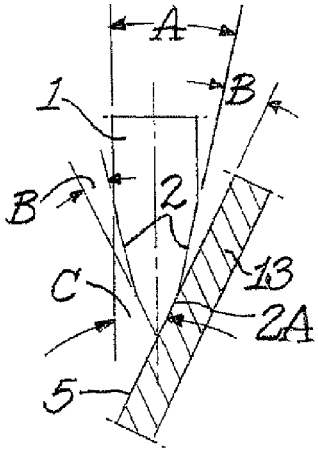

1
126
124
13
124
123
125
122
128
123
139
132

APPARATUS FOR PRECISION STEELING/CONDITIONING OF KNIFE EDGES

CROSS REFERENCE TO RELATED APPLICATIONS

This application is a continuation-in-part of Ser. No. 11/839,650, filed Aug. 16, 2007 now U.S. Pat. No. 7,517,275, which is a continuation in part of Ser. No. 11/123,959, filed May 6, 2005, now U.S. Pat. No. 7,287,445. Ser. No. 11/123,959 is based upon provisional application Ser. No. 60/568,839, filed May 6, 2004. Ser. No. 11/123,959 is also a continuation-in-part of Ser. No. 10/803,419, filed Mar. 18, 2004, now U.S. Pat. No. 7,235,004. Ser. No. 10/803/,419 is based upon provisional application Ser. No. 60/457,933, filed Mar. 27, 2003.

BACKGROUND OF THIS INVENTION

Manual sharpening steels have been used for years with the belief that they are a means of straightening the burr from knife edges following the sharpening of edges with manual or powered abrasive stones. Butchers have found the manual sharpening steel to be useful when slaughtering or butchering in work areas removed from electrical power and running water. The exact nature of what can occur during the steeling process has been until recently the subject of extensive speculation with little understanding of mechanisms that can occur at the edge of a blade as it is being impacted under controlled precisely repetitive conditions against a sharpening steel.

Use of the manual steel rod has been more of a mystique than a science, lacking any scientific base or understanding. It has been said for example that the manual rods "smooth out microscopic nicks in the blades surface and realigns the molecules in the cutting edge". Also one reads that "the best steels are magnetized to help draw the molecules into realignment," or "the alignment of molecules in a knife blade are reinforced whenever it is sharpened, . . . and the process removes very little actual metal from the blade". Others repeat that the use of a steel "realigns and smoothes the knife's edge". Most often, it is thought that the steel "burnishes against the hard surface of the cutting edge for the purpose of straightening it back out so that it is the same way as when it was manufactured".

Clearly steeling of knife blades has been a poorly understood art and not a science. It is clear to those founded in science and physics that the force of magnetism incorporated in some commercial sharpening rods is far too feeble to have any effect at the atomic level in steel and even too feeble to alter the physical structure of any burr attached to the edge.

In the prior art the angle of the facet as presented to the hardened surface of the manual sharpening steel has been totally random and entirely dependent on operator skill. For this reason, prior means of steeling knife edges lack the precision and reproducibility discovered by these inventors to be necessary for creating an optimum consistent physical structure along the cutting edge of blades irrespective of the geometry and size of the blade geometry or the skill of the user.

While manual sharpening steels have been sold for many years they have not become popular with the general public because they are dangerous to use and a very high degree of skill and practice is required to realize any improvement in the cutting ability of a dull knife edge.

SUMMARY OF THIS INVENTION

These inventors have recently demonstrated that if a knife edge previously sharpened at a given angle is repeatedly pulled across a hardened surface, generally harder than the metal of the blade, at a precisely and consistently controlled angle relative to the sharpening angle of the same blade that a remarkably consistent and desirable microstructure can be created along the edge of the knife blade. It has been shown that a manual sharpening steel can be used as the hardened surface needed to create this novel edge structure. This is a form of edge conditioning unlike conventional sharpening or conventional steeling.

In order to realize the optimum edge structure along a knife edge these inventors have found as explained in more detail in following sections that the plane of the edge facet is best held at an angle close to the plane of the hardened surface at their point of contact and that the angular difference between those planes must be maintained every stroke after stroke of the blade facet as the knife edge is moved along and against the hardened non-abrasive surface, or sharpening steel.

The unique microstructure which can be created along the knife edge consists of a remarkably uniform series of microteeth with dimensions generally equal to or less than the width of a human hair. The microteeth are very regular and strong and they can be readily recreated along the edge if any are damaged in use of the knife edge. Creation of this microstructure requires that the knife edge facets be held at a precise and reproducible angle relative to the sharpening steel, stroke after stroke. Under optimum conditions, the desired edge structure develops with only a small number of such strokes across the edge of the hardened surface or steel. Further unlike manual steeling which has lacked reproducible control of the angle, under the conditions described here the edge is not dulled, instead the original sharpening angle is retained even after hundreds of steeling-like strokes—so long as precise control of the angle is maintained.

THE DRAWINGS

FIGS. 3-4 illustrate a knife blade that can be enhanced in accordance with this invention;

FIG. 5 illustrates in cross-section a portion of a prior art knife sharpener using abrasive sharpening members;

FIG. 6 is a side elevational view of a knife blade sharpened by abrasive members leaving a burr;

FIG. 7 is a cross-sectional view in elevation showing the conditioning of a knife blade in accordance with this invention;

FIG. 8 is a perspective view showing the conditioned knife blade with microteeth along the edge;

FIGS. 9-10 are cross-sectional views showing the conditioning of a knife blade in accordance with this invention;

DETAILED DESCRIPTION

Figure 1:
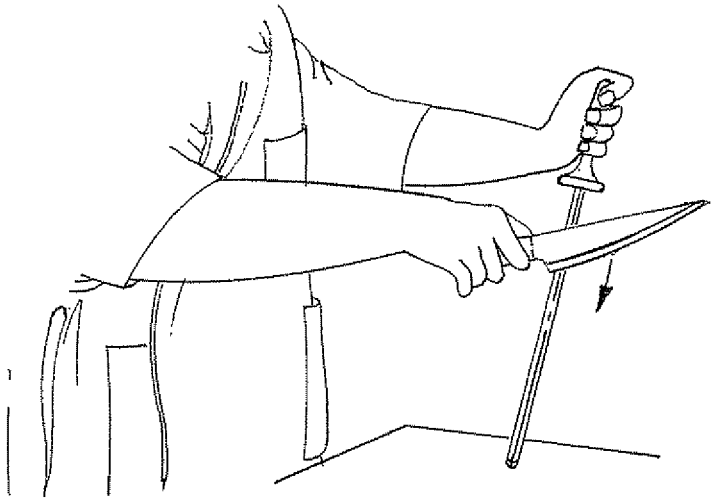
Fig. 1. (Prior Art)
FIGS. 1 and 2 illustrate prior art steeling techniques.

Conventional manual so-called "sharpening" steels are usually constructed with a handle by which the steel rod can be held or supported. The steel is often held end-down against a table or counter by one hand as in FIG. 1 (prior art) while the knife is held in the second hand and stroked simultaneously across and down the surface of the steel. Neither the angle of the steel or the angle of the blade across the steel is accurately controlled. Each can vary stroke to stroke or drift in angle during the steeling process and between successive steeling. Alternatively the sharpening steel is held in the air FIG. 2 (prior art) without support as the steel knife blade is moved across and along the surface of the steel. This latter approach offers even less control of the relative angles between the planes of the edge facets and the plane of the contact point along the steel. The sharpening steel has proven to be a poor haphazard and inconsistent tool for improving the cutting ability of a knife edge. Even the most skillful and persevering artisans who use a steel end up with edges of poor edge quality, not very sharp and very fragile requiring re-steeling after every 50 or so cuts. Frequent resharpening of the edge with an abrasive stone has proven necessary and the life of the knife is consequently shortened.

The improved apparatus and methods developed by these inventors to produce superior cutting edges depends upon precise and consistent control of the angles during the edge conditioning process. The present description relates a variety of apparatus that incorporate a hardened sharpening steel or sections of hardened rods to achieve surprisingly effective cutting edges on knives. A conventional knife blade 1, shown in section, FIG. 3 has two faces 3, which are sharpened at their terminus to form two facets 2, which converge along a line creating the edge 6. Sharpening as contrast to steeling a knife blade involves the use of abrasives to physically abrade away metal of the blade along each side of the knife edge creating edge facets 2 on each side of the edge 6.

In order to realize optimum results with the edge conditioning apparatus for knives described here, it has been demonstrated that it is important first to create (sharpen) the blade facets 2 at a precisely established, known angle relative to faces 3 of the blade. FIG. 4 represents a typical blade where the facets 2 are sharpened at an angle A relative to the respective faces 3 of the blade. If the sharpening angle A is precisely established as created with a precision sharpening means such as shown in FIG. 5 the edge facets subsequently can be precisely positioned using the same reference plane namely the face 3 of the blade. The sharpening means illustrated in FIG. 5 uses the face of the blade 3 as a reference plane for the blade that rests on a guide face 8 and alternating on guide face 8*a*. The facet 2 is moved into contact with the surface of abrasive disk 9 which at the contact point with the facet is set at angle A relative to the guide surface 8 and the blade face 3. In this prior art sharpener FIG. 5 the abrasive coated disks 9 and 9*a* are rotated by a motor driven shaft 10. Pins 12 on the shaft engage in slots that are part of the disk support structure in order to rotate the disks. Each of the two blade facets are commonly sharpened at the same angle A.

When the knife facets are sharpened as described a burr 4 is left along the edge of the blade. See FIG. 6. The abrading process leaves a burr because the lateral force necessary to abrade the facet and sharpen the edge exceeds that necessary to bend the very fine thin edge being formed. The edge becomes literally a foil like structure at the terminus of the facets and that structure is readily bent. It is commonly believed and taught that the manual steel is used to straighten out that burr and to align it with the transverse axis of the blade at the edge. What actually happens with a hardened steel rod can indeed be very different from that if the relative angles of the facet and the hardened surface are precisely controlled, and if the contact pressures and the angular relationships are maintained stroke after stroke.

Consequently if the blade facets 2 are at angle A and the facets are presented repeatedly and consistently in a sliding motion in contact with the surface of a hardened material (such as a manual steel) at Angle C which is close to Angle A, FIG. 7, a remarkably desirable microstructure can be created along the knife blade. Ideally, to achieve this angular difference B between the angle C and angle A, angle B is less than 10 degrees preferably closer to 5 degrees. Guide faces 7 and 7*a* align with the face 3 of the blade 1 to set the plane of the facet, presharpened at angle A, at an angular difference B between the plane of the hardened surface 5 of the plane of the hardened rod 13 at the point of contact.

The desirable microstructure that can be created by the precise control of the angular relationship of the plane of the edge facet with the plane of the hardened surface is illustrated in FIG. 8. After the burr 4 of FIG. 6 is completely removed, an amazingly regular row of microteeth is created along the knife edge. If individual microteeth along the edge are damaged or broken off when the blade is used for cutting, those microteeth will be replaced by successive movement of the facet along the hardened surface, alternating the strokes along one side of the edge and then the other. The repeated and alternating stresses created along the cutting edge by this motion hardens the knife's metal, making it more brittle and prone to fracture and fragment. This causes small sections of the edge to drop off leaving a microtooth-like structure along the edge. As one continues to stroke the edge on alternate sides of the edge, more microteeth drop off as new microteeth are formed. That process can be repeated many times.

In creating the optimum edge structure by the novel and precise means described here, the hardened contact surface of member 13 will initially make contact with the facet only at the extremity of the facet 2, FIG. 9 adjacent to the edge. As the burr is removed, the hardened surface will also remove microscopic amounts of metal adjacent to the edge and the lower most section of the facet will after many strokes, begin to be re-angled to an angle closer to that of the hardened surface. Thus a line and larger area of contact 2A, FIG. 10 develops between the lower section of the facet and the contacted surface 5 on the hardened member. This growing area of contact 2A, FIG. 10 resulting from many repetitive strokes of the facet against the hardened surface is important to stabilize the localized pressure against the developing edge structure and thereby to reduce the probability of prematurely breaking off the microteeth during subsequent reconditioning of the edge. This mechanism which relies on the highly precise and consistent angular relation between the facet and hardened surface reduces the opportunity for the hardened surface to impact under the edge and knock off the microteeth by that impact rather than by the desirable repetitive wearing along the side of the facet and the resulting stress hardening and fracturing process.

The hardened member 13 can be a manual "sharpening" steel. Such steels are sold with a variety of surface treatment and hardness. Consequently, some will be better than others in developing the unique microstructure described here and represented in FIG. 8. However, most manual steels are of a quality that can produce good results if an adequately precise angle control is provided to orient the plane of the edge facet precisely and preferably within 5-10 degrees of the plane of the steel surface at the point of contact with the edge facet. It is to be understood that as used herein the reference to "sharpening steel" is not intended to be limited to, for example, steeling rods made of steel, although that is the preferred practice of the invention. Instead, other equivalent materials could be used. What is important is that the materials should have a hardened surface which contacts the knife edge and should be of a hardness harder than that of the knife edge. For example, the hardened surface can have a hardness above Rockwell C-60. Such "sharpening steel" should be capable of developing the microstructure described here as represented in FIG. 8.

There are a number of possible designs for precision angle guides with the necessary angular precision that can be mounted onto a manual steel. Alternatively, the angle guide structure can be designed so that the manual steels or short lengths of manual steel rods can be mounted onto the guide support structure. These must have the required precision to control accurately the angular position of the knife and its facets relative to the surface of the steel stroke after stroke in order to create the optimum microstructure referred to in this patent. Several examples of such designs are described here to be representative of a large variety of designs that incorporate the necessary angular accuracy and reproducibility.

One of the most reliable and reproducible physical features of a blade that can be used as a reference in order to locate precisely the blade facets and edge structure relative to the hardened steel rod are the faces of the blade. Features which are affected by the thickness of the blade or the width of the blade has proven to be much less reliable. Consequently, the designs illustrated here rely on referencing the faces of the blade resting against a reliable angle guide for precise angular orientation of the edge facets on the steel structure as this microstructure is created.

When using a manual steel repeatedly without precise angular control, the relatively precise angle and geometry of the facets created in the prior abrasive sharpening process are steadily destroyed. The original sharpness of the edge is lost, the facets and the edge become rounded and the edge is quite dull. This process occurs quite rapidly particularly with the unskilled person and the blade must be resharpened with an abrasive frequently thereby removing more metal from the blade and shortening its effective life and usefulness.

As pointed out in patent application Ser. No. 10/803,419, now U.S. Pat. No. 7,235,004, it is preferred that the hardened surface of the object which conditions the knife edge should be non-abrasive. The invention, however, can be broadly practiced where the hardened surface is slightly abrasive. What is important is that the hardened surface should be sufficiently smooth or non-abrasive so that in combination with the knife guide the combination comprises means to minimize interference with burr removal and to repeatedly create and fracture a microstructure along the edge of the blade at the extreme terminus of the edge facets during repeated contact of the facets and the hardened surface to create a microserrated edge. Preferably, the hardened surface of the steeling rod would have a surface roughness no greater than 10 microns.

Figure 13:
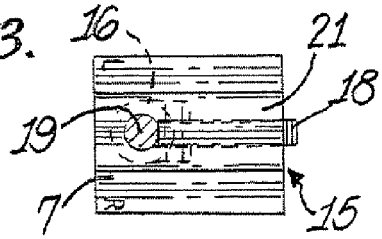
FIGS. 11-15 illustrate a guide for the conditioning of a knife blade in accordance with one embodiment of this invention.
Figure 11:
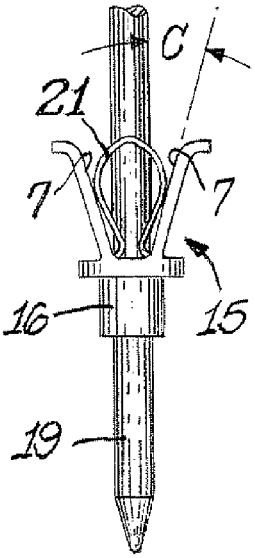
Figure 12:
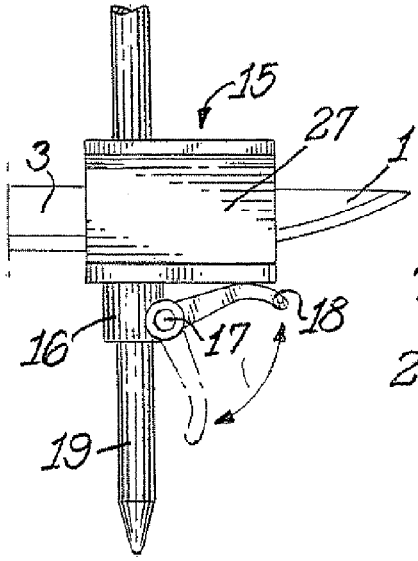
Figure 15:
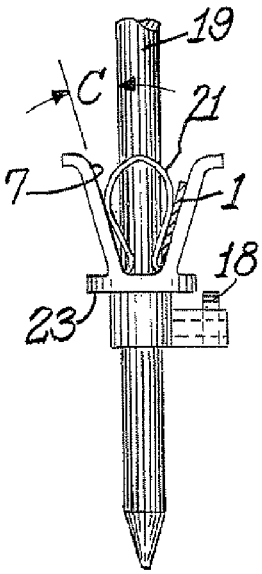

An example of a precision knife guide 15 that can be mounted on a manual steel 19 or a section thereof is shown in FIGS. 11, 12 and 13. This guide 15 is constructed with a tight sleeve-like collar 16 that fits snugly around the steel and which can be provided with a locking mechanism 17 for example that cams against the steel and can be tightened by a manually operated lever 18 to position this guide at any desired location along the length of the steel. The mounting and locking structure must be designed with sufficient care that the guide planes are held firmly and securely relative to the steel 19 as the face 3 of knife 1, FIGS. 12 and 15 is moved along and in intimate contact with the guide planes surface 7. An optional spring 21 can be provided to insure that the face of blade 1, FIG. 15 is pressed into intimate contact with the guide surface face 7 on every stroke, Ideally, the guiding surface forms an acute angle with the surface of the manual steel in order that the knife facet is stopped by the steel as the knife edge is pressed into the acute angular vertex formed by the guide and the surface of the steel.

Figure 14:
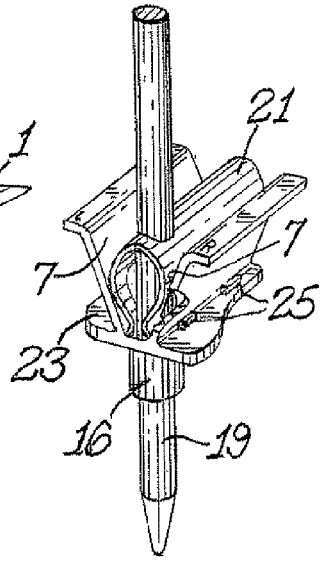
Figure 14A:
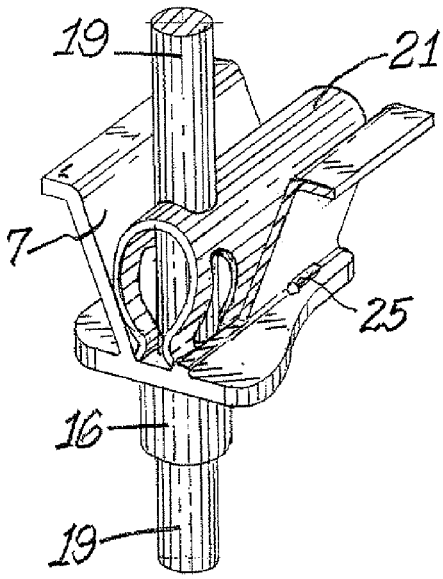

The spring 21 is designed to conform closely to the geometry of the guide planes 7 in the absence of the blade. Spring 21 can be supported and centered as shown by the steel rod or alternatively it can be supported by the base structure 23 for the guides. As shown in FIG. 14, it can extend the full length of the guide planes to provide support along the length of the blade and to press the blade against the surface of the guide including the tip of the blade as it is withdrawn along the guide structure. The springs can as designed with short "feet" 25 that insert through matching slots in the guide plates 27 to hold the springs down and in place.

This precision guide can be moved up or down the steel or it can be rotated around the steel to provide fresh areas of the steel surface for contact with the edge facets as previously used areas show significant wear. The guide can be readily moved and relocked in the new position.

While the angle C of the guide planes is shown as fixed, it should be clear that interchangeable guide plates 27 with different angles can be made available to coordinate with the angle of the sharpening device used initially to abrade and set the angles A of the edge facets. Alternatively, the guide 15 and the guide plates 27 can be designed so that the angle C is adjustable and individually angularly adjustable.

Figure 2:
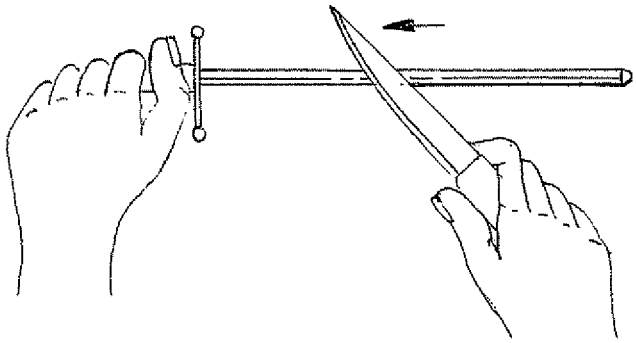
Fig. 2. (Prior Art)

The use of a spring 21 to hold the blade precisely is desirable for the best results but its use is of course optional. A full length manual steel or a shorter section of steel can be used in this design. If a conventional steel is used, its point or end can be rested on a table or counter as shown in FIG. 1. Alternatively, as described, later this type guiding mechanism can be mounted on a table or counter and a steel or an equivalent rod can be mounted in and clamped to the angle guide.

Alternative examples of precision angle guiding structure 29 to develop these desirable edge microstructures are shown in FIGS. 16, 17, 18 and 19. Each of these contain a support structure 31 with one or more vertical slots 33 to align precisely moving knife guides 29 with one or more steels 13. The knife guide planes 7 are consequently set at angle C relative to the plane of the steel rods 13 at the point where the facets of knife 1 will contact the steel rods. (It should be recognized that hardened steel rods or bars of shapes and surface structures other than the conventional steel rods can be used in these designs.)

Figure 17:
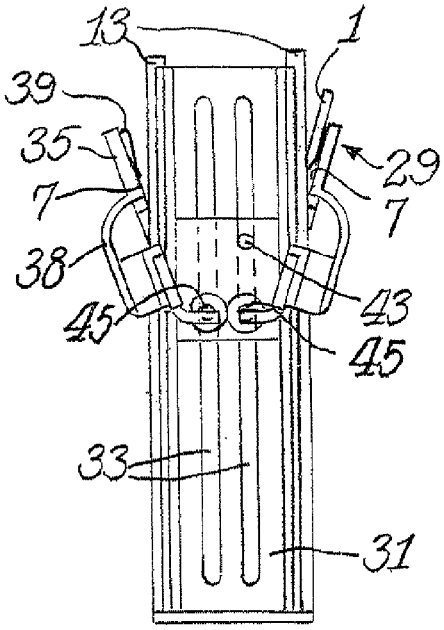
FIGS. 16-19 illustrate an alternative guide in accordance with this invention.
Figure 16:
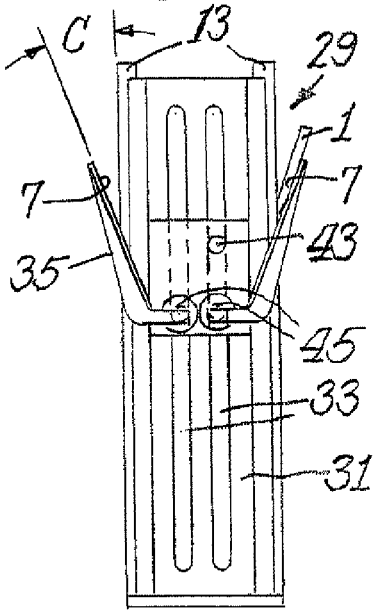

As one face of knife 1, FIGS. 16 and 17 is positioned in intimate contact with the guide plane 7 it can be moved along that guide plane while the edge facet remains in contact with the steel rods 13. The spring 39 is desirable but not necessary to insure good contact of the blade face with guide plane 7. A second spring mechanism 41 shown in FIG. 18 can be incorporated to hold the moving guides 35 in a rest position but to allow the moving guides 35 to be displaced downward by the user as he applies a downward force on the blade as its face is held in contact with the knife guide plane 7 and the edge facet is held in contact with the surface of the steel 13. This unique design allows a facet of the blade simultaneously to move transversely to the surface of the hardened steel 13 and to move longitudinally along the surface of the steel. This combined motion gives the user the options of moving the blade edge across the steel, along the axis of the steel, or in combination in order to create slightly different microstructures along the edge. Importantly, however regardless of that motion, angle C always remains the same during each stroke along the entire edge length. The sharpness of the edge and the integrity of the formed microstructure depends highly on retaining the angle C stroke after stroke within a closely controlled angular range.

In this arrangement pin 43 extends thru one of the guide slots to prevent any change in alignment of the sliding guide structure 35 with the axis of the steel rods. Similar pins 45 extend into the slots 33 into close conformity with the slot width to prevent lateral movement of the moving guide structure, 35.

The hardened steel rods 13 can be rigidly mounted onto base structure 31 or they can be supported on a slightly elastomeric or spring-like substrate that will allow them to move laterally a small amount in response to any significant variation in pressure from the knife edge structure as it impacts the steel surface.

The rate at which the desired microstructure develops and is reconstituted along the knife edge is related to amount of pressure applied by the knife edge facet as it is moved in contact with the hardened steel surface. There is a large amplification of the force applied manually to the blade as that is translated to the small area or line of contact between the facet and the steel surface at the movement of contact. That stress level can be moderated and made more uniform by only a very slight lateral motion of the steel surface.

Figure 18:
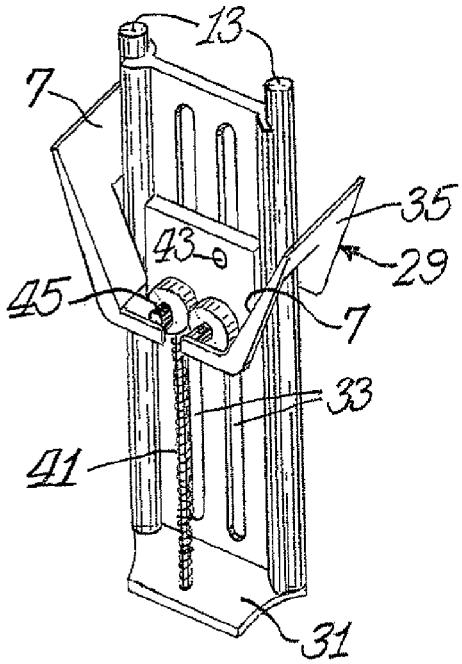
Figure 19:
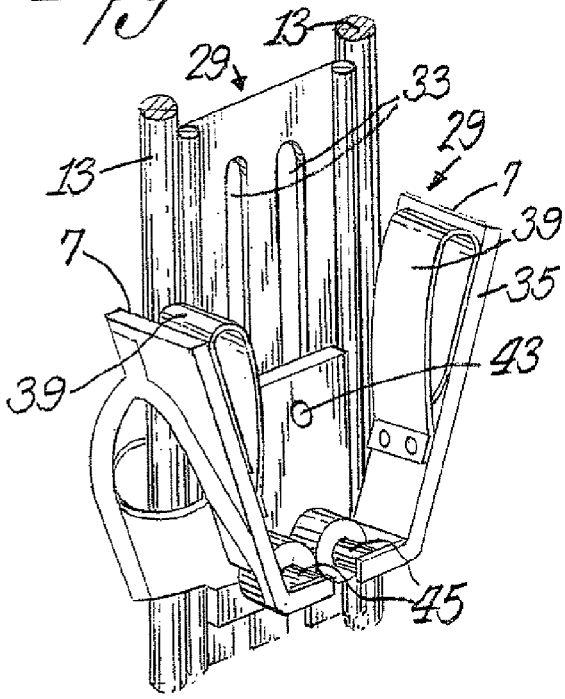

The guide and the knife holding spring mechanism of FIG. 19 can be readily modified to include a longer knife guiding surface and a second spring extending to the opposite side of the steel rod with larger guide surfaces similar to those of FIGS. 16 and 18. The knife holding spring 38 of FIG. 17 likewise can be on one or both areas of each guide surface. Further, the guide support arms can be designed to be replaceable or adjustable to provide the means to vary or set angle C optimally in relation to the original sharpening angle A that created the original angle of the knife facets.

The various unique structures of controlling the angle of the knife as described and illustrated to optimize the novel results and edge conditioning obtainable by precision angle control when passing the knife facets into close angular contact with a hardened steel rod or other hardened surface are equally applicable to sharpen facets at precise angles in contact with abrasive surfaces. Accordingly, the invention can be practiced using an abrasive surface instead of a steeling member.

Figure 25:
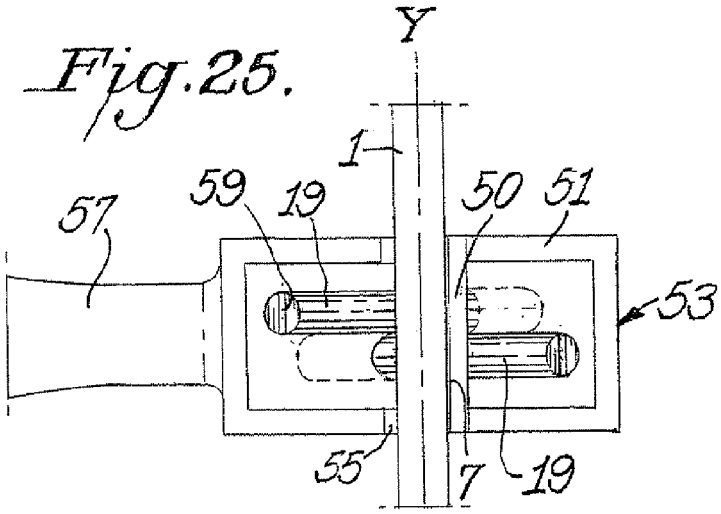
FIGS. 24-25 are side elevational and top views of an arrangement utilizing plural steeling members in accordance with this invention.
Figure 24:
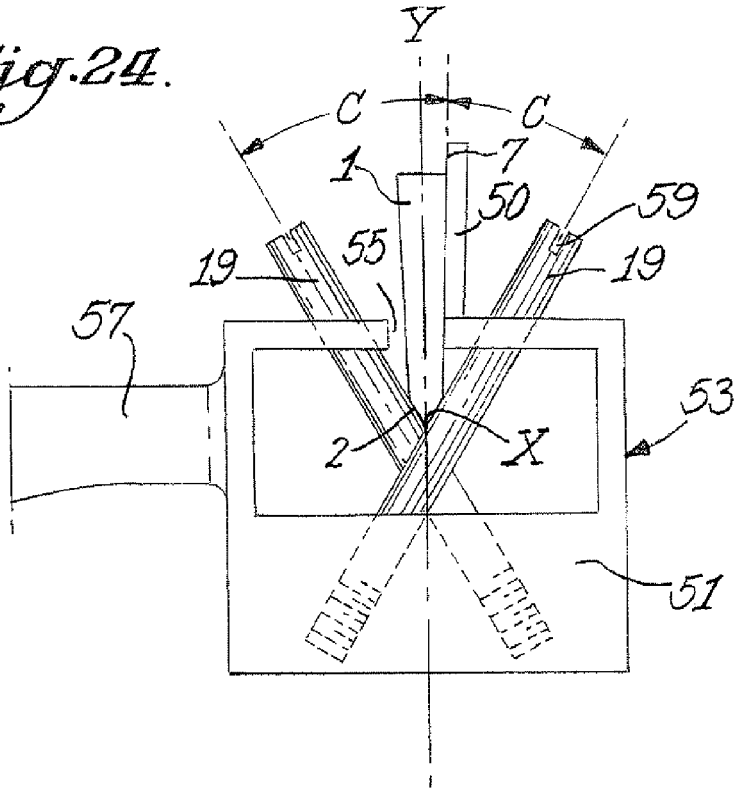

A further example of a novel structure of creating this unique microscopic structure along a knife edge is illustrated in FIGS. 24 and 25. In this unique arrangement a fixed knife guide plane 7 is created on one side of a rigid planar guide structure 50 attached to the body of 51 of the steeling apparatus 53. Sections of steel rods 19 are mounted by threaded ends into the body of apparatus 53. The two steel sections are crossed as seen in FIG. 24 at a total angle equal to twice angle C. The edge X of knife blade 1 is lowered into a slot 55 until its facets 2 contact one or both of the steel rods along the line of the edge. More than two steel rods 19 can be aligned in this manner in order to create a well defined line of contact for the knife edge facets with these steel rods 19. The guide structure 50 which establishes the position and alignment of guide plane 7 is offset slightly to one side of the centerline Y-Y of the blade which passes thru the vertex of the angles C that coincides with the line where the steel rods 19 cross. The amount of offset of plane 7 from the centerline Y-Y is approximately half of the thickness of blade 1. If desired the plane 7 can also be slightly angled in order to conform perfectly to any small taper that may characterize the blade faces.

In the apparatus of FIGS. 24 and 25, a handle 57 can be provided to stabilize the unit as it is being used or alternatively it can be physically attached to a table or other structure. In use, the face of the knife is aligned with the guide plane 7 and held in good contact with that plane as the blade edge is stroked back and forth along the surface of the steel rods 19 until the desired microstructure is created along the cutting edge. A physical spring (not shown) can be added to press against the blade and to hold its face in good sustained conformity with the guide surface. Likewise, a magnet can be added to attract the blade face to the guide face 7 as the blade is laid against that plane. The areas of contact where the blade facets contact a selected point on the surface of the steel rods can be changed and adjusted by rotating the rods using the slots 59 to extend or retract the rods accordingly. An obvious advantage of this configuration is that both edge facets can be conditioned simultaneously. By adding more than two rods, even better confirmation of the facets with the rods can be obtained. Without the precise angular control shown in this apparatus, the optimal microstructure will not be created along the knife edge.

Precision apparatus such as described here for control of the angle while steeling a knife can be incorporated into food related work areas such as into butcher blocks, cutting boards, and knife racks or knife blocks so that they are conventionally and readily available in those areas where knives are commonly used.

Figure 21:
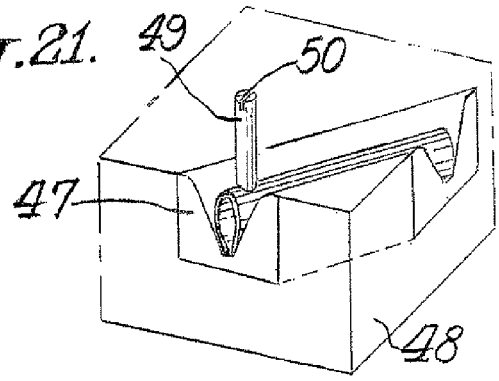
FIGS. 20-23 are perspective views showing alternative manners of mounting a guide in accordance with this invention.
Figure 22:
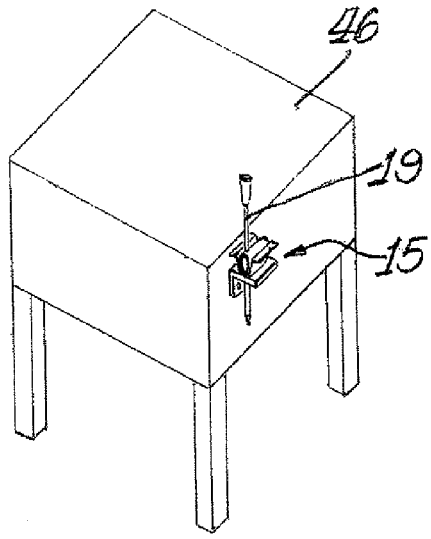

FIG. 22 illustrates how for example the guide 15 of FIGS. 11, 12, 13 and 14 can be attached to a counter butcher block. A manual butcher steel can be inserted into the guide structure as shown in FIG. 22 or a section of a steel or hardened steel rod can be mounted in the guide structure as in FIG. 21. The guide structure can be attached by a bracket as shown or embedded in a corner or parameter section of a counter or block-like surface as illustrated in FIG. 21.

Figure 20:
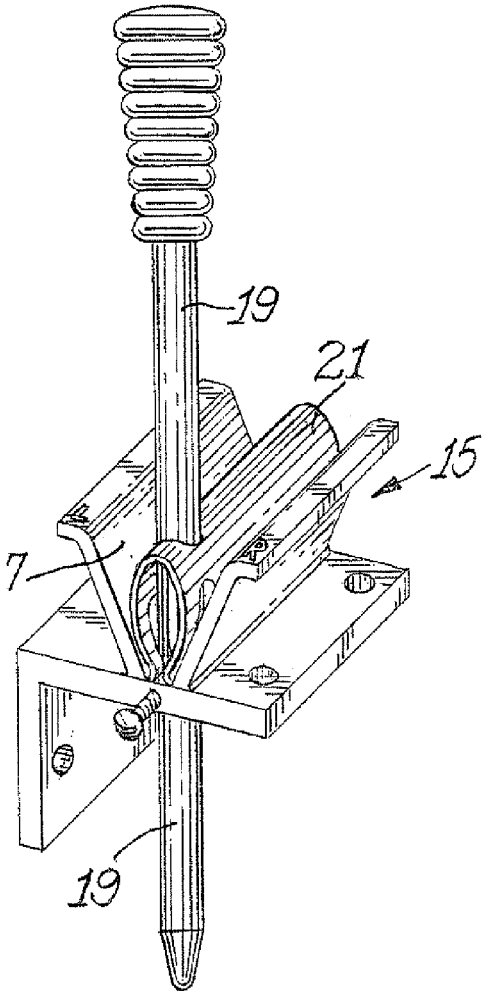

FIG. 20 illustrates a mountable angle guide 15 designed to accept a manual steel 19 a section of a steel or a hardened metal rod. This guide incorporates a convenient angle bracket so that it can be attached to any of a variety of knife work benches or work structure. For example, it is shown attached to a knife block 52, FIG. 23. It can similarly be mounted on a salad prep table or work table, or butcher's block, FIG. 22. The angle guide 15 and steel 19 could also be detachably mounted to an electric knife sharpener.

FIG. 21 illustrates an embedded guide structure 47 as it would be mounted in the corner of a butcher block or cutting board 48. The length of a hardened steel rod 49 mounted in this guide can be shortened if desired so that it does not protrude above the top of the cutting board. That hardened rod 49 is slotted so that it can be rotated with a coin or screw driver to expose new areas of its surface. The rod 49 can be provided with an extended threaded section (not shown) on its lower end to allow the rod to move upward or downward as it is rotated to expose fresh areas of the rod surfaces.

Precision embedded guides such as illustrated in FIG. 21 can be mounted entirely within the perimeter of butcher blocks, counters and knife blocks, thus avoiding the awkwardness of an attachment-like structure.

Figure 23:
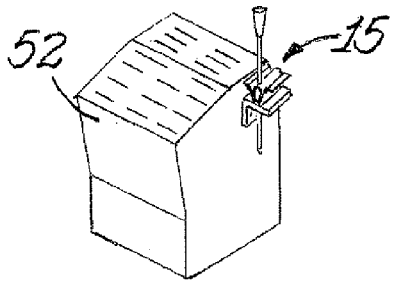

FIG. 23 illustrates a mounted precision guide on a knife block. Clearly, the physical location of the guide can be on the side of such blocks or embedded within the top structure of such blocks so long as clearance is provided for the blade as it is moved along the guides and in contact with the guide planes.

FIGS. 21, 22, and 23 are intended only to be illustrative of the wide variety of locations where it is desirable to provide a means for precisely steeling the knife edge. This aspect of the invention generally involves providing a holder which can mount the angle guide and the sharpening steel to a support surface such as a food cutting board or a butcher block. Such holder would include first mounting structure to mount the holder itself to the support surface. The first mounting structure could be of the type such as illustrated in FIG. 22 where the holder itself is separate and distinct from the support surface and is mounted to the support surface by utilization of the downwardly extending flange connected to and extending away from the guide 15. Alternatively, the first mounting structure could be by having the holder itself integral with the support structure. The holder would also have second mounting structure for securing the steeling rod or hardened surface in a fixed position so that it is properly spaced with respect to the angle guide. The angle guide itself would also be mounted to the holder.

The present invention also includes the following features from parent application Ser. No. 11/123,959, now U.S. Pat. No. 7,287,445, which are carried forward from its parent application Ser. No. 10/803,419, now U.S. Pat. No. 7,235,004, by reference thereto.

Figure 26:
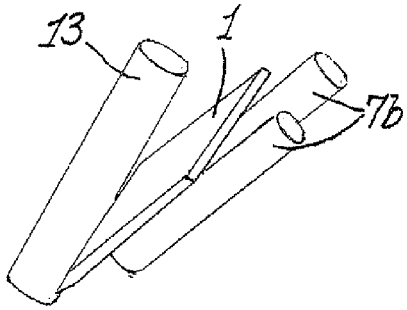
FIG. 26 shows an alternative guide structure.

The guide surface described here can be extended flat surfaces or a series of two or more rods or rollers arranged to define an extended plane on which the blade can rest as its edge facets are being sharpened or conditioned in contact with a hardened surface. FIG. 26, for example, shows the blade 1 guided by two rods or rollers 7*b* defining an extended guide plane opposite hardened surface member 13. It is important that the hardened surface have adequate hardness, however the supporting structure under that surface need not necessarily be of the same hardness.

The concepts of this invention can be practiced by incorporating its features in a manually operated device such as shown in FIGS. 27-31.

Figure 27:
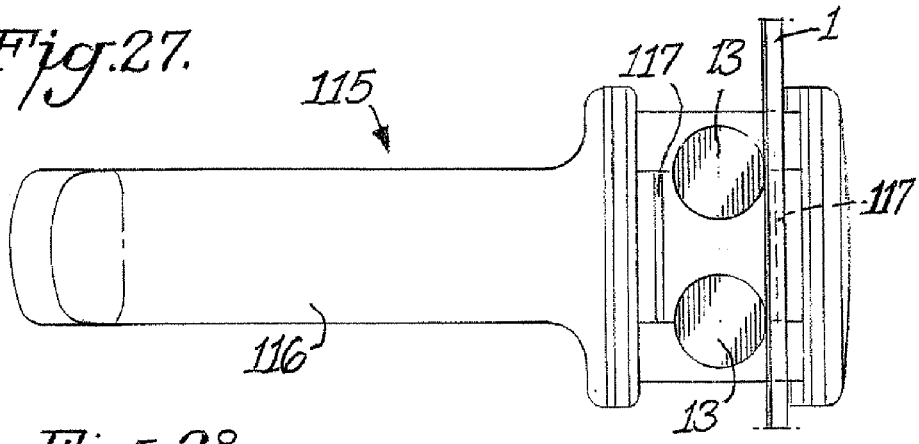
FIGS. 27-35 show various apparatus which could be used in accordance with this invention for sharpening and conditioning knife edges.
Figure 28:
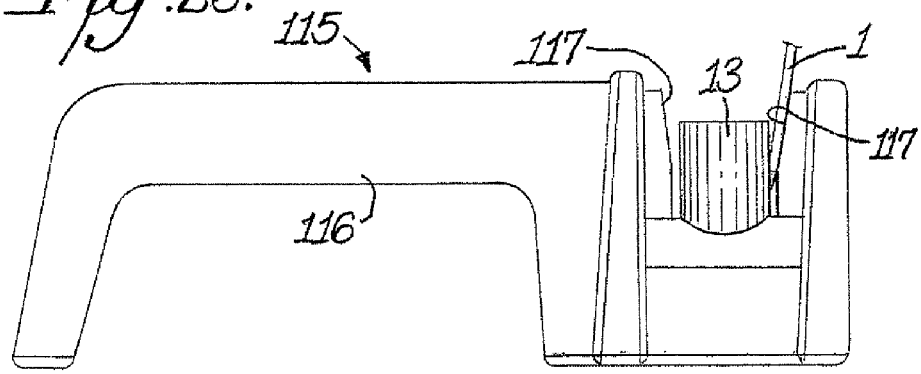
Figure 31:
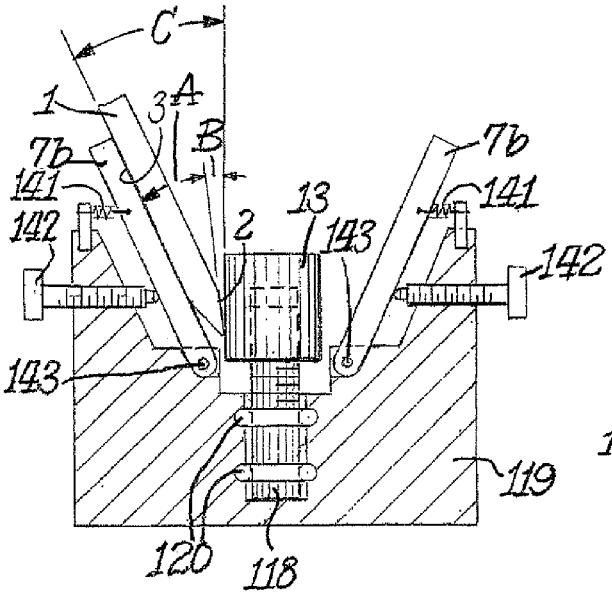

FIGS. 27 and 28 show one structure for a precision manual edge conditioner in accordance with the principles detailed above. Hardened members 13 are mounted nominally centrally between elongated knife guides 117 in a physical structure 115 which has an attached handle 116 that can be conveniently gripped with one hand while the face of blade 1 is drawn alternately with the other hand along the surface of guides 117. The length of guide 117 is adequate to insure very accurate alignment of the blade edge with the guide and the contact surface of hardened members 13. The use of two hardened members 13 is optional but it has the advantage that in the structure 115, the edge conditioner can be used conveniently by either a right or left handed operator and have the advantage of two hardened members for more rapid sharpening of some blades and the advantage that the entire length of edge can be conditioned up to the bolster or handle. Alternatively, a single hardened member 13 can be similarly located between the guides. Members 13 are sized and located as shown centrally between the guides so that the edge of the blade facet will contact one or both of the members as the blade is drawn along the elongated guide surface and pressed against the contact surface of the hardened member. The angle of the elongated blade guides can be selected so that the angle between the planes of the edge facet and the plane of the hardened surface is optimized for the blade whose edge is being conditioned. Mechanical means for example such as in FIG. 31 can be incorporated to permit adjustment of the angle of the guide means so that angle C, FIG. 31 can be optimized for the particular angle of the facets of the blade edge being conditioned. FIG. 31 illustrates the mechanical means for adjusting the angle of the guide means. As shown therein each guide 7*b* is pivotally mounted at 143 to support member 119. A spring 141 urges each guide 7*b* to rotate in a direction away from hardened member 13. A stop member 142 is threadably mounted through support member 119 to limit the rotational movement of guides 7*b*. Thus, the spring force of each spring 141 urges each guide 7*b* against stop 142 to establish angle C. That angle is adjusted by adjusting the position of stop member 142. Alternatively as described subsequently a combined precision knife edge sharpener, either manual or powered together with a precision manual edge conditioner provides in one apparatus control of both angles A and C and insures optimum results of the edge conditioning step.

Hardened member 13 can be cylindrical, oval, rectangular or any of a variety of shapes. That member preferable will have a hardness greater than the blade being sharpened. The radius of its surface at the line or points of contact can be designed to optimize the pressure applied to the blade edge as it is forced into contact with that surface. That effective radius at the line or area of contact can be the result of the macro curvature of the hardened member or the result of micro structure such as grooves and ribs at that point. For best results such grooving, ribbing or ruling along the surface should be approximately perpendicular to the line of the edge being conditioned and in any event, the alignment of the grooves or rulings preferably cross the line of the edge. The invention can be practiced with the axis of such ribbing at an angle other than perpendicular, including tilting the ribbed surface or spiraling the ribs to establish an alternate angle of attack.

Figure 36:
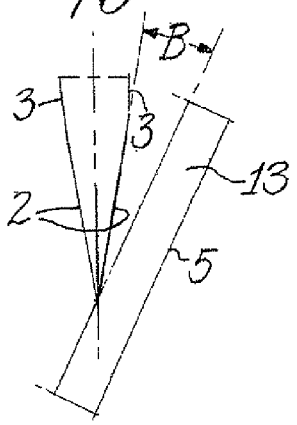
FIGS. 36 and 37 show in detail the angular relationship of the edge facet and the hardened material necessary to create this optimum edge structure.
Figure 37:
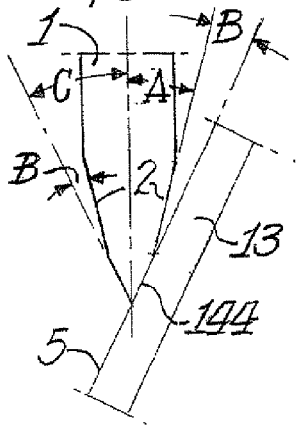

In creating the optimum edge structure by the novel and precise means described here, the hardened contact surface 13 will initially make contact with the facet only at the extremity of the facet 2, FIG. 36 adjacent to the edge. As the burr is removed, the hardened surface will also remove microscopic amounts of metal adjacent to the edge and the lower most section of the facet will after many strokes, begin to be re-angled to an angle closer to that of the hardened surface. Thus a line and larger area of contact 144, FIG. 37 develops between the lower section of the facet and the contacted surface on the hardened member. This growing area of contact 144 FIG. 37 resulting from many repetitive strokes of the facet against the hardened surface is important to stabilize the localized pressure against the developing edge structure and thereby to reduce the probability of prematurely breaking off the microteeth during subsequent reconditioning of the edge. This mechanism which relies on the highly precise and consistent angular relation between the facet and hardened surface reduces the opportunity for the hardened surface to impact under the edge and knock off the microteeth by that impact rather than by the desirable repetitive wearing along the side of the facet and the resulting stress hardening and fracturing process.

It was found that localized axial ribbing along the surface of the hardened member is a convenient way to create an appropriate localized level of stress against the facet and the edge without damaging the microteeth being formed. The ribs, however are preferably individually rounded and not terminated in an ultra sharp edge that can remove metal too aggressively and consequently tear off the microteeth. The level of force must be adequate to stress the microteeth and generate fracturing below the roots of the microteeth and permit their removal and replacement after the cutting edge is dulled from use. The depth of such ribbing must also be controlled in order that such ribs can not remove a significant amount of metal along portions of the edge facets.

Figure 29:
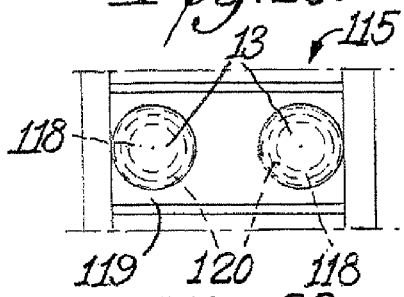
Figure 30:
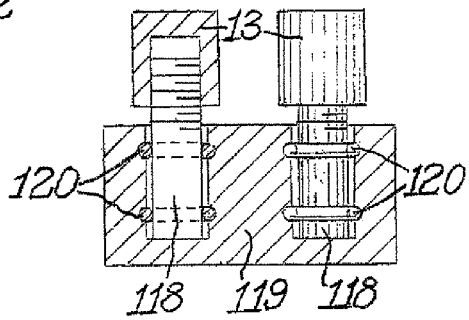

The hardened member 13, FIG. 27 can be secured rigidly to the structure 115 or alternatively the hardened member can be mounted on a structural element so that it is slightly displaceable against a restraining force as the knife edge facet is pressed into contact with the member. The restraining force can be supplied by a restraining mechanism, such as a linear or non-linear spring material or similar means. Designs are possible that allow the user to adjust or select manually the amount of restraining force and extent of displacement. FIGS. 29 and 30 illustrate one of many possible configurations that incorporate a restraining force concept. The hardened members 13 shown in FIGS. 29 and 30 can for example be cylinders or tubes with hardened surfaces or body hollowed and threaded internally that can be rotated on threaded rods 118 which extend into support member 119 drilled to accept the unthreaded sections of rods 118 which in turn are grooved to accept elastomeric O-rings 120 which support and physically center the rod 118 in the drilled holes in support member 119. If such or similar structures are mounted in the apparatus of FIGS. 27 and 28, when knife 1 FIGS. 27 and 28 is inserted along the elongated guide 117, the hardened member 13 will be contacted by the knife edge facet 2 and displaced slightly angularly or laterally by the application of sufficient downward force to blade 1, causing lateral force to be applied to O-rings 120. The degree of compression of the O-ring and the resulting angular displacement of hardened member 13 can be limited by physical stops or other means in order to maintain the contact angle B, FIG. 31, preferably within 1-2 degrees of the optimum value. By allowing the hardened member to displace slightly in this manner with a controlled resistive pressure, it is possible to minimize the opportunity for excessive forces to be applied by the operator who is applying manually the force between the knife and the hardened member. Excessive force can be detrimental to the progressive process of removing the burr and creating the microstructures along the edge in a optimum manner. However, if it becomes desirable to accelerate the rate of development of microteeth, greater pressure can be applied to the knife, the angle B will increase slightly and the microteeth will develop faster. It was discovered that there is an optimum level of resistive pressure and this apparatus provides a means to create and maintain that optimum level. Commonly a resistive force between 1 to 3 pounds is optimum. The threaded connection of the hardened member to the support rod 18 allows the user to rotate and raise or lower the hardened member 13 in order to expose fresh surfaces of the hardened member to the edge facet 2 as the surface of the hardened member becomes distorted, loaded with debris, or worn excessively by repeated contacts with the blade facets. The threaded connection can be sufficiently tight that the hardened member 13 does not rotate as the knife edge is rubbed against its contact surface. Alternatively, the threaded connection may be loose enough to rotate slowly as a result of rubbing and frictional forces as the blade edge is pulled across the surface of hardened member 13. In that sense, the threaded connection may be considered a braking mechanism which prevents rotation of the rotatable cylindrical object unless a torque is applied to the cylindrical object in excess of that applied by such braking mechanism. The hardened surface preferably will impart little to no conventional abrasive action against the edge structure. If there is any abrasive action along the edge it must be sufficiently small that it does not interfere significantly with the slow process of burr removal by non-abrasive means or prematurely remove the fine microstructure being formed along the blade edge. As explained later herein, an advantage has been shown in some situations for a very light abrasive supplementary action along the edge to reduce slightly the width of the microstructure but this action must be extremely mild and applied with great care in order not to remove the microstructure being created by the hardened member.

The mechanism of FIGS. 27-31 is simply one example of the configurations that can be used to carry out the precision edge conditioning process while maintaining close control of the angle B between the plane of the facet 2 and the plane of the hardened member 13. The shape of the surface and the shape of the hardened member can be varied widely to accommodate alternative means of guiding the blade accurately and of establishing precisely the angle B between the surface of hardened member 13 and the blade facet 2. Clearly a variety of alternate restraining means including wire and leaf springs can be used to position the hardened member and to allow but offer resistance to controlled displacement of hardened members. Alternative means can be used to permit movement of the hardened members to expose fresh areas on their surfaces which can be used to condition the edge. A sharpener incorporating both a precision sharpening stage and the edge conditioning mechanism shown in FIGS. 29 and 30 permits accurate control of angle B and the creation of edges with optimal conditioning as described earlier.

As mentioned earlier herein the surface of the hardened member can be embossed, ruled or given a structure or patterning that will create higher but controlled localized pressures and forces to be applied along the knife edge in order to assist in removal of the burr structure and creation of microstructure where it is otherwise necessary to apply greater manual forces on the blade itself. Such microstructure might include a series of hardened shallow fine ribs, for example 0.003 inch to 0.020 inch apart, on the surface of the hardened member where the axis of the individual ribs is preferably aligned perpendicular to but in any case at a significant angle to the line of the edge as it contacts the hardened surface. Preferable such ribs should be shallow so that they can not remove excessive amounts of metal from the facets adjacent the microstructure being formed. The plane of such ribs defined by the plane of the area, points or line of contact adjacent the contacting blade facet must, however, be maintained at the optimum angle B as described herein in order to realize the optimum microstructure. The optimum size of such ribs depends in part on the hardness of the blade material.

Possible geometries for the hardened surface needed to create the edge microstructure described here can include repetitive geometric features with small radii on the order of a few thousandths of an inch. It is important, however to understand that the conditioning step described here is not a conventional skiving operation which normally will remove, reangle or create a new facet without regard for the detailed and desired microstructure along the edge itself. Instead this invention is a precision operation to remove carefully the burr of a knife, that previously has been sharpened conventionally, by pressing the knife edge against the surface of a hardened material at a precisely controlled angle B to that surface with enough pressure to progressively and significantly remove the burr, to fracture the edge at the point of burr attachment and to create a relatively uniform microstructure along the edge. It would be counterproductive to skive off the entire facet (or to reangle the entire facet) which, like coarse and aggressive sharpening would create a new facet and recreate a conventional burr along the edge and leave a very rough and unfinished edge.

This invention is a unique means to condition a conventionally sharpened edge so that a highly effective microstructure is established along the edge while simultaneously maintaining a relatively sharp edge as defined by its geometric perfection.

A high degree of precisely repetitive micromanipulation is necessary to create this favorable type of edge. In addition to the need to establish precisely the angle between the surface of the facet and the surface of the hardened material at the point of contact, it is critical to insure that this angle of attack is maintained on each and every stroke of the knife edge along its entire length. The angle of attack must be maintained with a repetitive accuracy of approximately plus or minus 1 to 2 angular degrees. Such precise repetition is necessary to avoid seriously damaging the microteeth or altering the nature of edge structure being created along the edge. Further the pressure applied by the knife facet against the hardened surface must be optimized in order to avoid breaking off prematurely the newly formed microteeth. The force developed along the edge of the facets by the repetitive sliding contact smoothes the sides of the microteeth but stresses them and strains them in a manner that repeatedly fractures their support structure at a depth along the edge significantly below the apparent points of their attachment. This repetitive process leads ultimately to the removal of the microteeth and their replacement with a new row of microteeth created by the repetitive fracturing of the supporting edge structure below each "tooth". The amount of force exerted against the microteeth on each stroke is dependent upon the downward force on the knife blade as applied by the user. It is important to realize that the localized force against the microteeth can be very large because of the wedging effect at the blade edge between the elongated angled knife guide and the hardened surface. The force that must be applied by the user is consequently relatively modest and certainly less than if the force had to be applied directly in the absence of a knife guide. It would be very difficult to apply consistently this level of force to the knife edge by any manual non-guided stroking procedure.

In general, the hardened material should not be an abrasive. The described processes removes the burr, creates microteeth along the edge and wears micro amounts of metal from the facet adjacent the edge by basically a non-abrasive process. The rate of metal removal by any abrasive can easily be too aggressive compared to the miniscule amounts of metal that will be removed while creating and recreating the ordered line of microteeth along the edge.

The edge conditioner illustrated in FIGS. 27 and 28 contains two hardened members 13 so that the apparatus will be equally effective if used by either right or left handed persons. Clearly this arrangement permits one to condition the full length of a conventional knife, particularly including that portion of the edge adjacent to the handle or bolster. If there were in this apparatus, which has an elongated guide 17 to insure accurate angle control, only one such member 13 either the right handed or left handed person or both would find it impossible to comfortably condition the entire length of the edge to the bolster or handle of the blade. In order to condition the edge close to the bolster while providing an elongated guide for the blade face one hardened member must reside on one side of the conditioner so that the entire edge can contact it up to the bolster and handle of the blade.

As mentioned earlier, the hardened surface should not have an inherent tendency to abrade. The surface should not be coated with conventional aggressive larger abrasive particles of materials such as diamonds, carbides or abrasive oxides. These materials when in sizable particulate form typically have extremely sharp edges that give them aggressively abrasive qualities. However, these same materials are extremely hard and when prepared in large planar form and highly polished are essentially non-abrasive. The edge conditioning process disclosed here relies on precisely applied angular pressure by a hardened surface against the facet at its edge in order to repeatedly create and fracture a microstructure along the edge at the extreme terminus of the facets. The process of repeatedly rubbing the knife facet and edge structure against the harder surface stress hardens the facet adjacent to the edge, fractures the edge below the edge line and deforms the metal immediately adjacent to the edge. The metal along the lower portion of the facet adjacent the edge is deformed, smeared by the localized contact pressure and microsheared as a result of the very small differential angular alignment of the plane of the hardened surface and the plane of the edge facet. Thus the localized contact pressure slowly fractures the microteeth along an edge and slowly and selectively re-angles the lower portion of the facet to conform closely to the plane of the hardened surface. It is clear that if the differential angular alignment is too great or if there is any true abrasive action at the edge the microstructure that otherwise would be slowly created and recreated will be prematurely abraded away and destroyed. The rate of facet deformation and metal removal adjacent the edge must be minimized in order that the microstructure has time to develop and be protected from direct abrasion. The amount of wear along the lower portion of the facet that can occur from the inherent roughness of the hardened surface in the low micron range appears acceptable. Surface roughness (as contrast to dimensions of small repetitive geometric features) greater than about 10 microns will in some cases depending on pressures and the rate of microtooth development be about the practical limit, in order that such roughness does not lead to excessive metal removal while the optimum microstructure is being created. Consequently it is important that the hardened surface not have significant abrasive quality.

Figure 32:
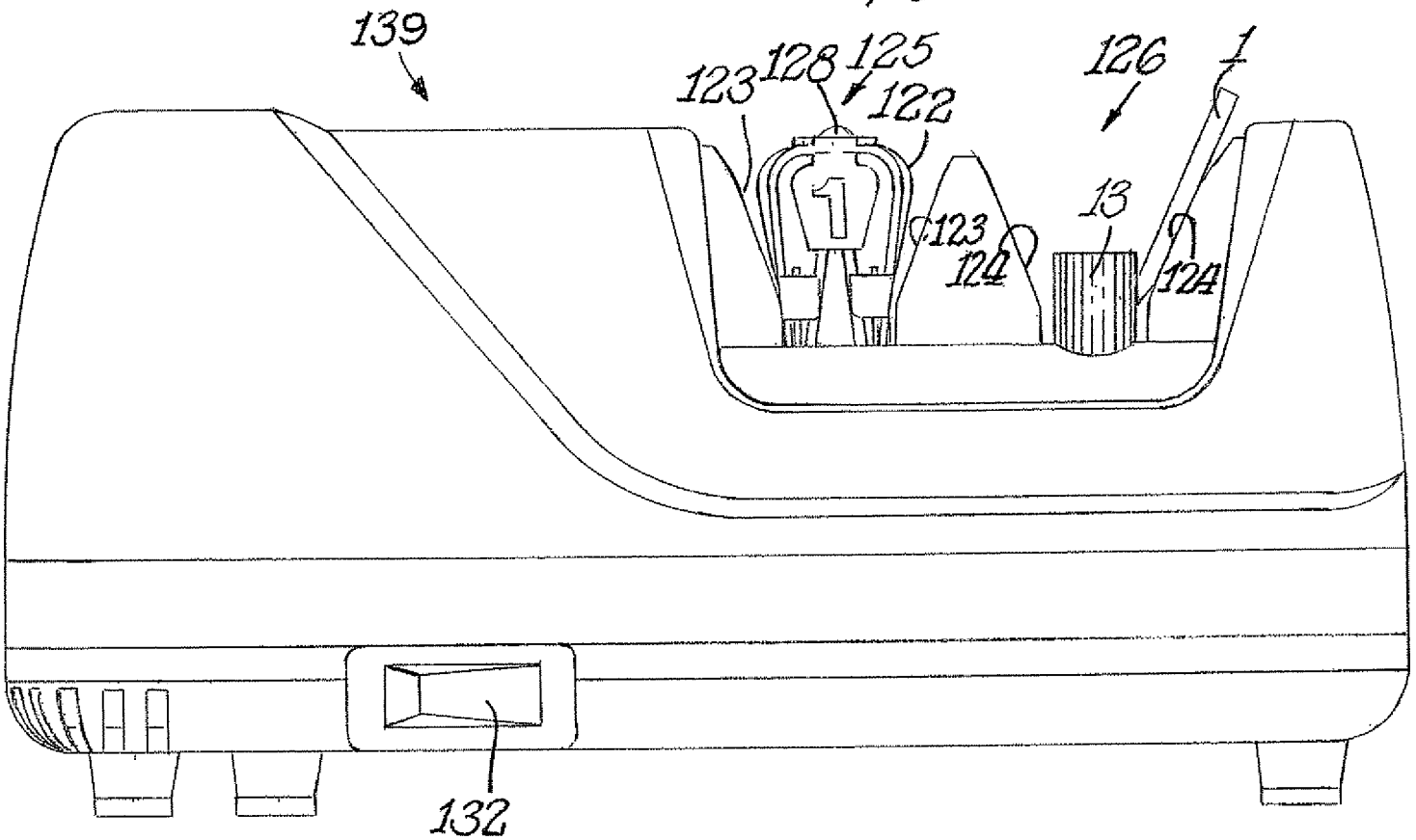
Figure 33:
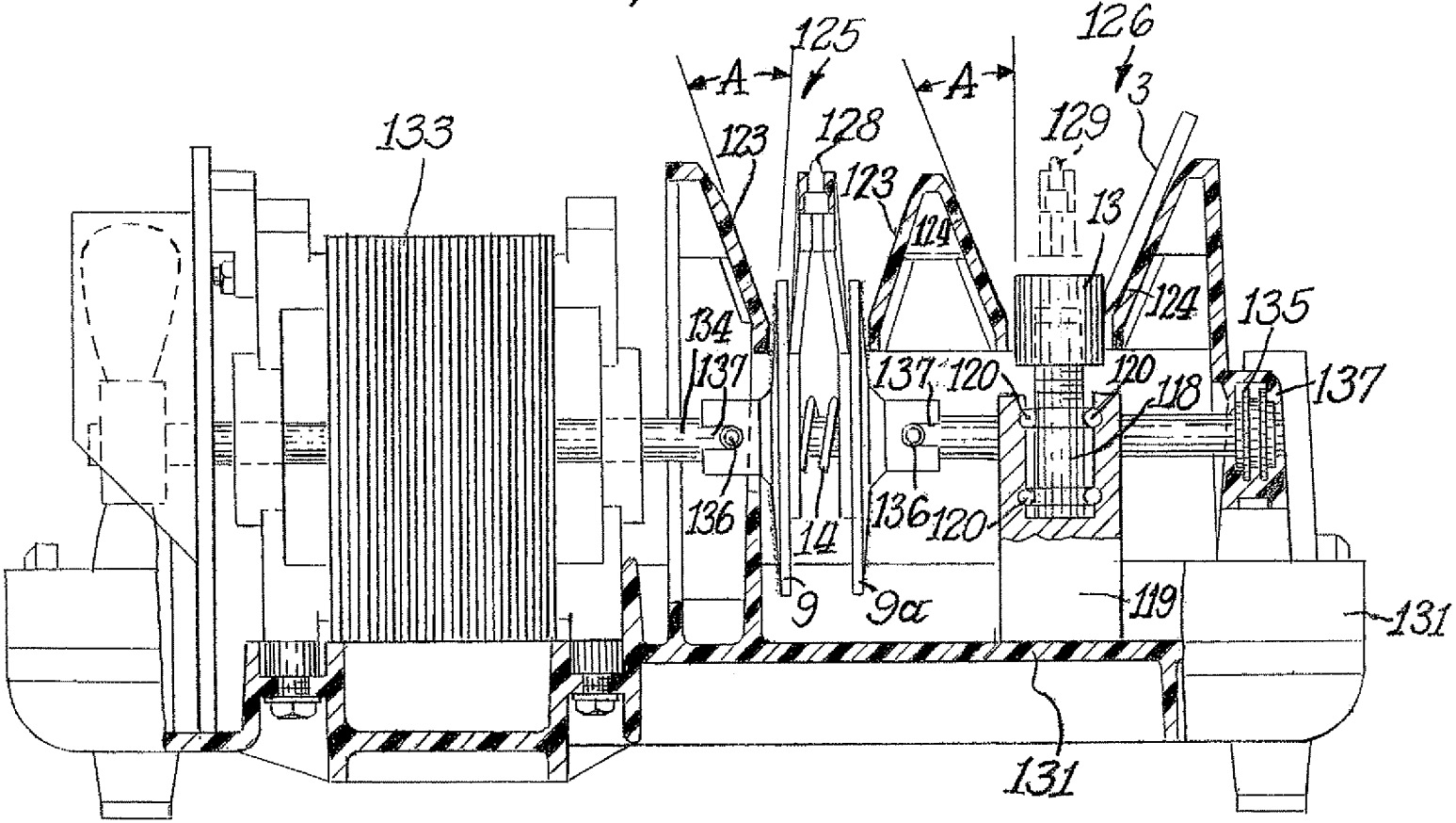

Because it is important to control angle B between the plane of the sharpened facet along the edge and the surface at point of contact with the hardened surface, in the optimal situation it is important as described above to control both angle A of the facet (FIG. 31) and angle C in the conditioning operation (FIG. 31) so that the difference angle B (angle A−angle C) is closely controlled. For this reason it is now clear that there is a major advantage to creating a single apparatus 139 such as shown in FIGS. 32 and 33 including a sharpening station and an edge conditioning station 126, each with precisely controlled angles A and C respectively. The sharpening stage can be either manual or powered but in this example the sharpening stage is powered. The first (sharpening) stage 125 of this apparatus has elongated guide planes 123 each set at angle A relative to the blade face and the abrasive surfaces. The guide planes 124 in the second (edge conditioning) stage 126 each are set at angle C relative to the contact surface of hardened member 13. The first stage FIG. 32 is shown with U-shaped guide spring 122 designed to hold the knife securely against elongated guide plane 123 as the knife is pulled along the elongated guide plane and brought into contact with sharpening disks 9 and 9*a* (FIG. 33).

The U-shaped guide spring 122 mounted to post 128 to hold the blade face securely against the guide surfaces 123 of FIG. 32 is illustrated for the first stage 125 but is omitted only for reasons of clarity in the second stage 126. FIG. 33, however, shows in phantom the post 129 for the guide spring in the second stage 126. This type of spring is described in U.S. Pat. Nos. 5,611,726 and 6,012,971, the details of which are incorporated herein by reference thereto. It is preferable, however to have a similar knife guiding spring 122 in the second stage 126 extending along the guide length in order to insure that the face of blade 3 is held in intimate contact with the elongated guide plane. That in turn insures that the blade facet is oriented relative to the contact surface of member 13.

The hardened member 13 is supported on structure 119 that is positioned forward of drive shaft 134 or slotted to allow uninterrupted passage and rotation of shaft 134 which is supported at its end by bearing assembly 135 supported in turn by structure 137 attached to base 131. Structure 119 likewise is part of base 131 or a separate member attached to base 131. Hardened member 13 supported by and threaded onto rod 118 in this example can be displaced laterally when contacted by the blade cutting edge facet, the amount of such displacement being controllable by selection of appropriate durometer and design of the O-Rings, 120. Alternatively member 13 can be mounted rigidly on structure 119, to be immobile, but that alternative requires slightly more skill by the user to avoid applying excessive force along the cutting edge.

Experience with an apparatus as illustrated in FIGS. 32 and 33 demonstrated the distinct improvement of creating the edge microstructure under strict consistent conditions where the angular difference B, (C–A), was accurately controlled by the precision elongated guides to fall within the range of 3-5°. The advantage of having the sharpening and edge conditioning operation in the same apparatus is clear since each of the angles A and C is predetermined by the preset angle of the elongated guides. The sharpening process which must be designed to create full facets at the desired angle A can be carried out by any of theconventional means known to those skilled in sharpening including abrasive and skiving means. It was also observed that there is an advantage of using diamond abrasives in the sharpening stage in order to create rapidly precisely ground facets with a distinct burr. Diamonds are the most effective abrasive for sharpening and for cleanly removing the metal. Consequently diamonds create without overheating a very pronounced and cleanly defined burr along the edge of any metal regardless of its hardness. The process of creating an optimum microstructure along the knife edge depends upon starting with a blade that has been sharpened sufficiently to establish well defined facets then by applying pressure at a low angular difference B alternately on one side, then the other of the edge until any burr remnants are removed leaving a microstructure along the edge. As this breakup process proceeds it can be interrupted and the knife can be used for slicing food or other objects and subsequently conditioned further to improve once again or further the cutting ability of the edge structure. This reconditioning process can be interrupted and repeated many times until the reconditioning process becomes so slow that it is desirable to resharpen the edge and start with newly formed facets. It is important to note that by maintaining a small angular difference B during this process, the edge can be reconditioned many times before it needs to be resharpened to create a fresh precision facet at angle A.

The cutting ability of a knife edge depends on a variety of factors but most important are the geometric perfection of the edge and the nature of any microstructure along the edge that can contribute to the effectiveness of cutting certain materials, especially fibrous materials as related herein. The manual and powered devices described in this disclosure are designed to optimize and control the creation of a desirable fine microstructure along the edge. In the process of creating this microstructure the burr remaining from prior sharpening is progressively removed until it is virtually all removed leaving the microstructure. When the burr is removed the microstructure is created approximately as shown but the edge at its terminus may at times be wider than the edge would be if the facets 2 (FIG. 7) were to meet in a point. This is because of fragments remaining along or damaged microstructure resulting from use of the knife, These fragments in general are small but it is possible to reduce their size slightly without removing the microstructure being formed. It was found that by using a finishing process in the form of an extremely mild buffing or stropping action (not aggressive) precisely set at an angle very close to angle C it is possible if needed during the edge conditioning step to reduce the size of such fragments along the edge without significantly removing the microstructure being created by the means described. The effective angle D, FIG. 35 of this mild buffing means must be very close to angle C. It is evident that if it is exactly at the facet angle A, it can remove any debris outside the geometric projection of the facets and remove only minimal amounts of material from the facet itself. Such abrasive action if sufficiently mild can sometimes improve the geometric precision of the edge and reduce slightly the thickness of the edge without removing the tooth like structure of the microstructures created by the edge conditioning step. Experience shows such subsequent mild action can improve slightly the cutting ability of the edge for some materials. It is also clear that if angle D of this mild action step significantly exceeds angle C, it will rapidly remove the desired microstructure along the edge and create a burr structure. Hence this finishing operation must be conducted under highly controlled conditions at precisely the optimum angle related to the angle A of the initial aggressive sharpening action that created the original facets and the original burr.

Figure 34:
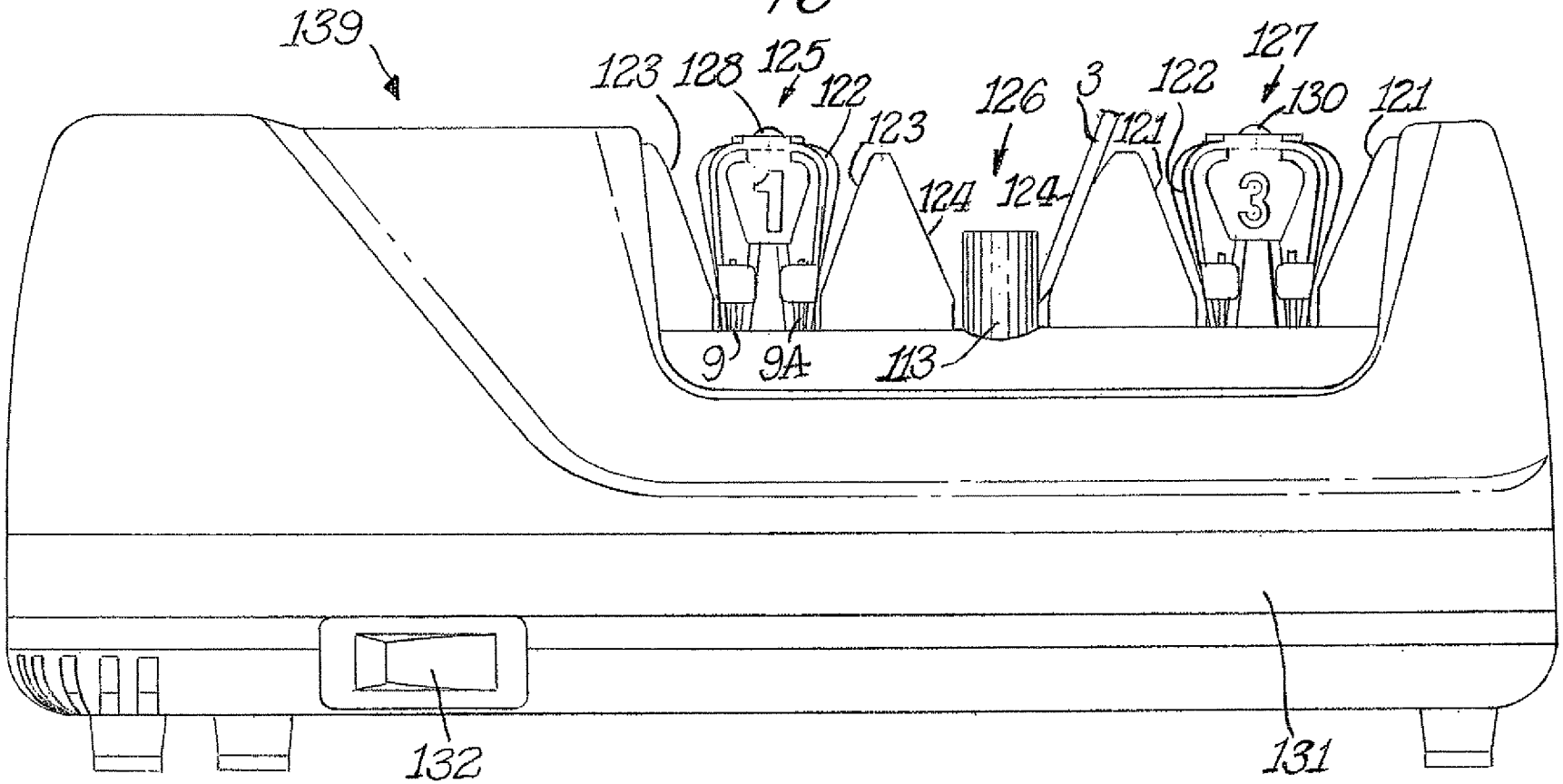
Figure 35:
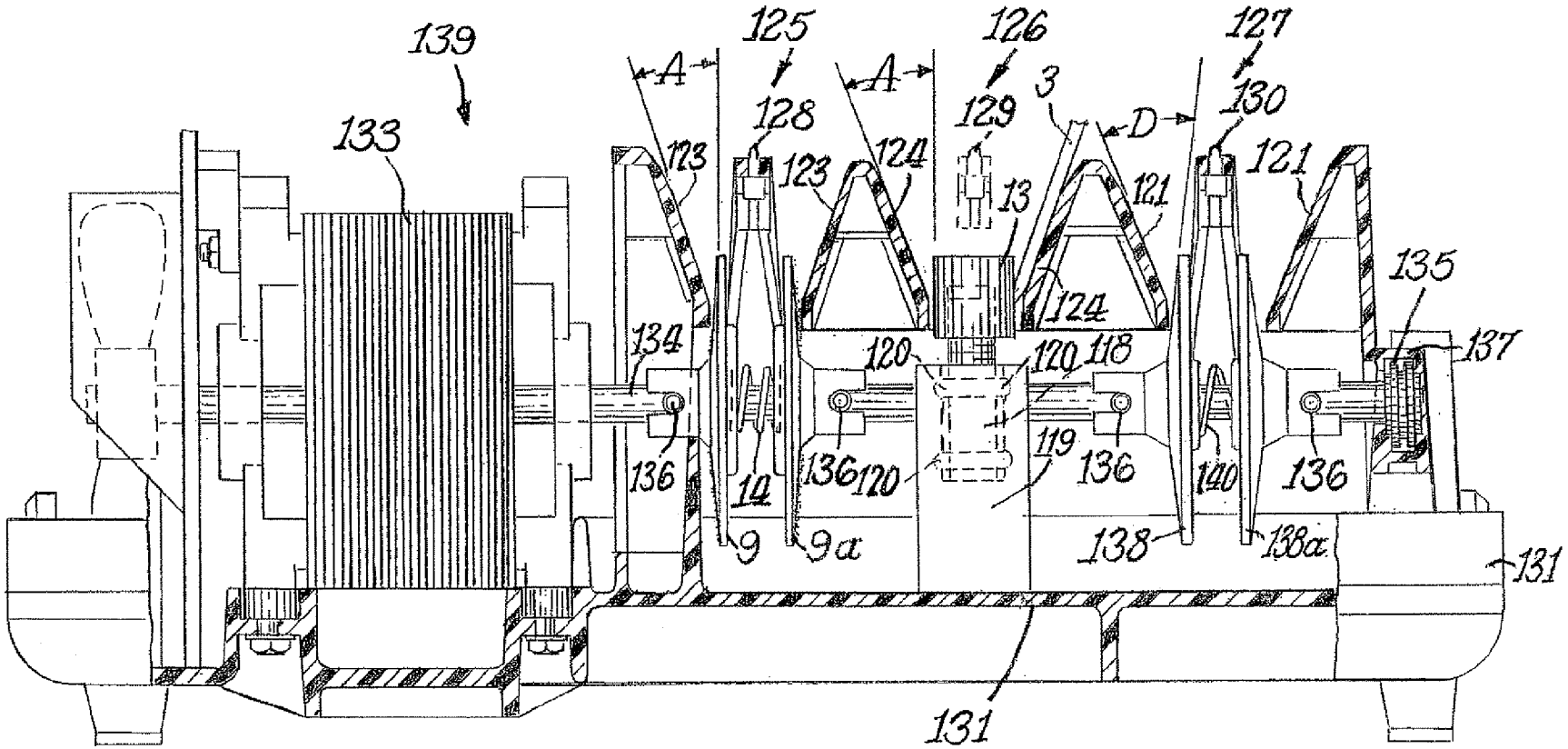

FIGS. 34 and 35 illustrate a motor driven three stage edge conditioning apparatus that includes a sharpening stage 125 designed to operate at angle A, an edge conditioning stage, 126 designed to operate at angle C, and a finishing stage 127 using a very mild buffing or stropping action designed to operate at angle D which must be close to angle C, preferable within 1 or 2 degrees. All of these angles are the angle between the controlling guide plane of that stage and the angle of the contact surface of the abrasives 9, 9*a*, 138 and 138*a* or the surface of hardened member 13. In this apparatus FIGS. 34 and 35 the first stage 125 might for example use abrasive disks 9 and 9*a* coated with 270 grit diamonds. The third stage disks 138 and 138*a* could be made of ultra-fine 3-10 micron abrasives, such as aluminum oxide embedded in a flexible matrix as described in earlier U.S. Pat. Nos. 6,267,652 and 6,113,476, all of the details of which are incorporated herein by reference thereto. In the third stage 127 the grit size preferably must be small (less than 10 microns) and the force of the restraining spring 140 or its equivalent must be exceedingly small, preferably less than 0.2 pounds, in order to avoid an action so great that the microstructure developed in Stage 2 would be prematurely removed or damaged.

In FIGS. 34 and 35, the edge conditioning stage 126 is basically the same as described earlier with reference to FIGS. 32 and 33. The guides for that stage are maintaining accurately the angle C.

Fresh areas of the surface on the hardened member 13 can be exposed by rotating the member on the threaded section of rod 118. While not shown, a hold-down spring such as spring 122 would generally be incorporated to press the face of blade 3 securely against the plane of elongated guides 124 in order to insure accurate angle control during the edge-conditioning process.

FIGS. 34 and 35 show the posts 128 and 130 for mounting the guide springs 122 for stages 125 and 127. FIG. 35 illustrates in phantom the post 129 that would mount the guide spring for stage 126.

The surface of disks in both the first stage 125 and the third stage 127 can, for example be sections of truncated cones. In determining the precise angles of contact in these stages it is important to establish the vertical angle between the plane of the surface of the guide and the plane of the surface on the abrasive surface at that point of knife-edge contact with the blade facet. The guides 123, 124 and 121 are elongated to permit accurate angle control as the face of the blade is moved in intimate contact with the elongated plane of the guide face. The disks 138 and 138*a* rotated on shaft 134 at for example about 3600 RPM can move laterally by sliding contact with the shaft against the restraining force of spring 140. By allowing the disk to move in this manner slidingly away from the knife facet as that facet is brought into contact with the surface of the disk, the opportunity for the abrasive to gouge the knife edge or to damage the microstructure is substantially reduced. As in the earlier FIG. 33, the lateral position of the drive shaft 134 is accurately established by the precision bearing assembly 135 held securely in a slot of structure 137 attached to the apparatus base 131. By accurately establishing the lateral position of the shaft 134, the disks are located precisely laterally relative to the guides 121, 124 and 123.

To use this apparatus the motor is energized and the blade is pulled several times along the guide plane with the edge facet in contact with the rotating disks 9 and 9*a* while alternating pulls in the left and right guides 123 of stage 1 until the facets and a burr are developed along the blade edge. The knife is then pulled along elongated guide plane 124 with the facet in contact with hardened member 13, a number of times alternating pulls along the left and right guides 124 of stage 2. The knife can then be used for cutting or it can first be pulled rapidly once along the left and right guides of stage 3 holding the blade edge in contact with the rotating disks 138 and 138*a*. Stage 3 must be used sparingly so as not to remove the microstructure along the edge. When the effectiveness of the blade is reduced from cutting, the blade edge can again be conditioned in stage 2. The edge can be reconditioned many times before it must again be sharpened in stage 1 as described above.

The preceding descriptions disclose a number of skill-free means for reproducibly creating a uniquely uniform microstructure along the edge of a sharpened blade where the means incorporates a highly precise angular guiding system for the blade so that very narrow areas of the blade facets adjacent the edge can be repeatedly moved across a hardened surface at exactly the same angle, stroke after stroke. This highly controlled action stress hardens the lower portion of the facets within about 20 microns of the edge causing fractures to occur in a reproducible manner in that small zone adjacent to the edge which in turn causes microsections of the edge to drop off along the edge leaving a highly uniform toothed structure along the edges The teeth so created are commonly less than 10 microns high and are spaced along the edge every 10 to 50 microns. These dimensions are comparable to or substantially less than the width of a human hair. The several apparatus already described herein operate by moving the knife edge against the hardened surface. A similar result can be realized by moving the hardened surface along the edge of a stationary knife edge but only if the angle of the hardened surface at the point or area of contact is held at precisely the same angle stroke after stroke. For optimum results the angular difference between the plane of the edge facet and the contact plane of the hardened surface should be on the order of 3-5 degrees and preferably less than 10°.

If the angular difference exceeds 10° the nature and frequency of the microteeth changes significantly and the cutting ability of the resulting edge is adversely ffected. Above 10° the microteeth are individually smaller, the spacing of teeth becomes less regular and at increasing angles the total number of substantial teeth is reduced. Further and importantly, at larger angle B the edge width W is greater and the edge is not as sharp. The advantages of keeping angle B small, for example, below 10° is clearly evident. It is also clear that in order to keep the conditioning angle C within such close proximity to the sharpening angle A on each and every conditioning stroke it is necessary to use precision guiding means. That is the only way the results described here can be obtained.

Figure 38:
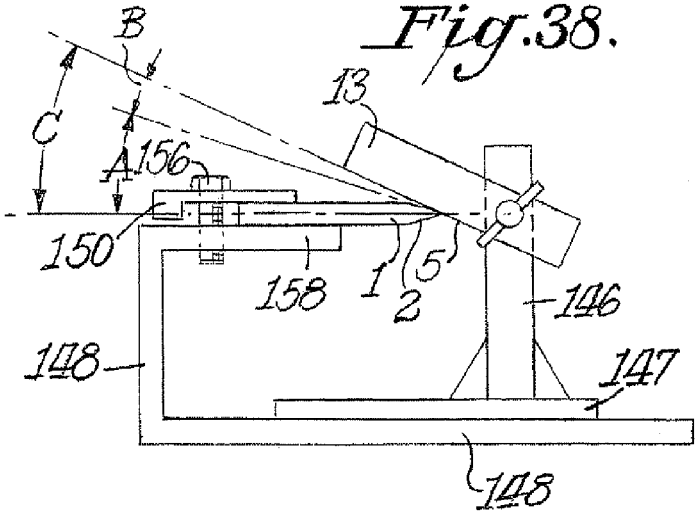
FIGS. 38-39 show practices of the invention with a clamped blade and precision means of moving a hardened object across or along the blade edge.
Figure 39:
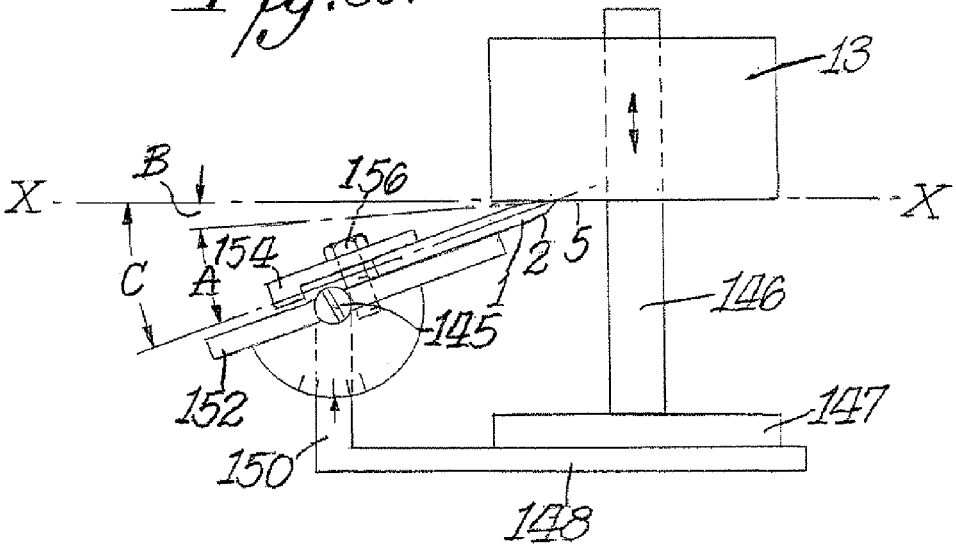

Two examples of an apparatus that creates similar microstructures by movement of a hardened surface along the edge of a blade at a controlled angular difference between the plane of the edge facet and the plane of the hardened surface are shown in FIGS. 38 and 39. In the first example FIG. 38, the blade 1 is mounted with its axis or centerline nominally horizontal. The plane of the edge facet is positioned at an angle of A degrees from the horizontal plane where A is the angle of the upper facet 2 with respect to the reference plane in which the blade centerline is located, as illustrated The angle of the plane of the hardened surface 5 to the horizontal is adjustable and is shown set at angle C with respect to the reference plane. The angular difference between the plane of the edge facet and the plane of the hardened surface is consequently C minus A equal to angle B, which optimally must be on the order of 3-5° and preferably less than 10°.

The hardened member 13 is attached adjustably to post 146 which is mounted on pedestal 147. The post 146 and pedestal 147 comprise a holder that can move slidingly along the angled base member or support 148. As the hardened member surface 5 is so moved manually along base member or support 148 in sliding contact with the lower portion of the upper facet 2 adjacent the edge, the amount of pressure applied to the edge facet by the hardened surface can be controlled by the user by pushing the hardened member with more or less force against the facet. The base member or support 148 is designed to support the blade 1 which is clamped to the upper platform 158 of base or support 148 by means of clamp 150 and an attachment screw 156. This blade clamping structure is thus located above the support portion of base or support 148 on which the holder (i.e. post 146 and pedestal 147) is slidably mounted.

In a second example of an apparatus incorporating a moving hardened surface 5, FIG. 39, the blade 1 is mounted so that the angular plane of its upper facet 2 is just B degrees less than the horizontal plane X-X that corresponds to the lower surface 5 of the hardened cylinder 13 which is lowered into physical contact with the edge of the upper blade facet 2. By adjusting angle C by means of the angle adjustment screw 145 the absolute value of angle B can be varied to the optimum level. The under surface of the weighted and hardened cylinder 13 can be smooth or scored with fine radial grooves and ribs in order to provide smaller areas of contact with the edge facet and thus provide greater stress levels along the edge for stressing and fracturing the edge as described earlier. The weight of the cylinder can be optimized or springs (not shown) can be added if needed to optimize the load placed on the facet by the hardened surface 5. This spring loading is an alternative or is a supplement to a weighted cylinder. The hardened surface can be moved slidingly along the height of post 146 which is attached to pedestal 147 which is free to slide on the support surface of angled base member or support 148. The support surface of angled base member or support 148 has a vertical post 150 on which is mounted an angularly adjustable plate 152 that holds the blade 1 by means of clamp 154 and fastening screw 156.

As is apparent from FIGS. 38-39 the sliding movement of the holder (post 146 and pedestal 147) is completely independent of any connection to or contact with the blade clamping structure in that both the holder and the blade clamping structure are completely distinct and separate from each other. In that regard, the blade clamping structure is mounted directly to the base member or support 148 while the holder is freely slidable on base member or support 148. The sliding movement of the holder permits the surface 5 of object 13 to selectively manually move into contact with the stationarily held blade facet at a controlled constant angle over the entire length of the facet.

FIGS. 38-39 illustrate a cylindrical member 13. It is to be understood that the cylinder could have either a horizontal or a vertical orientation with a corresponding horizontal or a vertical axis. FIG. 38 illustrates the member 13 with its surface 5 angularly adjustable, while FIG. 39 illustrates the blade clamping structure. Thus, the invention can be practiced with at least one of blade clamping structure and object surface to be angularly adjustable.

As previously pointed out the various unique structures of controlling the angle of the knife while applicable to contact with a hardened steel rod or other hardened surface are equally applicable to sharpen facets at precise angles in contact with abrasive surfaces. Accordingly, the invention can be practiced using an abrasive surface instead of a steeling member. In that regard, the examples of FIGS. 38 and 39 might be practiced where the surface 5 of object 13 is an abrasive surface. Accordingly, as regards FIGS. 38 and 39 the techniques may be considered as pertaining to a knife edge enhancing apparatus wherein the surface 5 is an edge enhancing surface which could be either abrasive or non-abrasive.

These inventors have shown repeatedly the surprising advantages of the microstructure that can be created if the knives steeled are with this level of angular control. The microstructure provided by these guided means is superior to manually steeled edges for cutting fibrous materials such as lemons, limes, meats, cardboard and paper products to name a few. The steeled edges remain sharp even after repetitive steeling and the knives need to be resharpened less frequently using abrasive means, thus removing less metal from the blades and lengthening the useful life of knives.

What is claimed is:

1. An apparatus for manually sharpening the edge of a knife blade with two faces each of which terminates in an edge facet which meet to form said edge, said apparatus comprising:

an elongated sharpening member having a hardened surface defining a longitudinal axis;

a knife guide having a guide surface disposed at a non-parallel acute angle to said longitudinal axis of said sharpening member whereby a face of said knife blade may be placed on said guide surface to enable an edge facet of said face to be held in sustained contact with said hardened surface while said face is drawn manually along said guide surface in a transverse direction nominally perpendicular to said longitudinal axis of said sharpening member, said knife guide being movably coupled to said elongated sharpening member to permit sliding movement in first and second opposing directions extending generally parallel to said longitudinal axis of said sharpening member; and a spring mechanism coupled to said knife guide, said spring mechanism reacting against said knife guide to force said knife guide in said first direction to an upper rest position, and said spring mechanism permitting said knife guide to be displaced from said rest position in said second direction as the user applies a downward force on said knife blade as said face is held in contact with said guide surface and said edge facet is held in sustained contact with said hardened surface.

2. The apparatus of claim 1, wherein said knife guide further comprises a knife holding spring mechanism coupled to said knife guide;

wherein at least a portion of said knife holding spring mechanism conforms closely to the geometry of the guide surface of said knife guide to define a slot in the absence of said knife blade; and wherein insertion of said knife blade in said slot forces contact of a face of said knife blade with the guide surface.

3. The apparatus of claim 1, wherein said knife guide is removable and replaceable with a second knife guide having a guide surface disposed at a non-parallel acute angle to said longitudinal axis of said sharpening member, wherein said non-parallel acute angle is distinct from the non-parallel acute angle of said knife guide.

4. A method for sharpening the blade of a knife, comprising sliding the blade in a first direction through a knife guide and against a hardened surface while simultaneously moving the knife guide and the blade in a second direction, perpendicular to the first direction, relative to the hardened surface from a first, rest position to a second position spaced from the rest position, and providing a spring mechanism reacting against the knife guide in a third direction, opposite the second direction, wherein after the knife guide is moved to the second position, allowing the spring mechanism to move the knife guide from the second position back to the rest position.

* * * * *